US011727848B2

(12) United States Patent
Seo et al.

(10) Patent No.: US 11,727,848 B2
(45) Date of Patent: Aug. 15, 2023

(54) DISPLAY DEVICE, METHOD OF RECEIVING IMAGE DATA AND COMMAND DATA, AND METHOD OF TRANSFERRING IMAGE DATA AND COMMAND DATA

(71) Applicant: SAMSUNG DISPLAY CO., LTD., Yongin-si (KR)

(72) Inventors: Hae-Kwan Seo, Hwaseong-si (KR); Dong-Wook Choi, Hwaseong-si (KR); Se Ja Chul Hwang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 74 days.

(21) Appl. No.: 16/936,728

(22) Filed: Jul. 23, 2020

(65) Prior Publication Data

US 2021/0201746 A1 Jul. 1, 2021

(30) Foreign Application Priority Data

Dec. 26, 2019 (KR) ..... 10-2019-0175607

(51) Int. Cl.
*G09G 3/20* (2006.01)

(52) U.S. Cl.
CPC ..... *G09G 3/2059* (2013.01); *G09G 2330/08* (2013.01); *G09G 2370/04* (2013.01); *G09G 2370/08* (2013.01)

(58) Field of Classification Search
CPC ..... G09G 3/20; G09G 2310/08; G09G 2310/0286; G09G 2300/0426; G09G 2310/0267; G09G 3/36; G09G 3/3266; G09G 2310/0275; G09G 2310/061
See application file for complete search history.

(56) References Cited

U.S. PATENT DOCUMENTS 5,493,329 A * 2/1996 Ohguchi ..... H04N 7/148 348/14.14
6,115,017 A * 9/2000 Mikami ..... G09G 3/3659 345/92
6,329,973 B1 * 12/2001 Akimoto ..... G06F 3/147 345/98
6,930,675 B2 * 8/2005 Ishiyama ..... G09G 5/14 348/565
7,034,792 B2 * 4/2006 Tamura ..... G09G 5/36 345/98
7,050,032 B2 * 5/2006 Tamura ..... G11C 7/16 345/98
8,427,546 B2 * 4/2013 Sato ..... H04N 5/23245 348/231.9

(Continued)

FOREIGN PATENT DOCUMENTS

KR 10-2016-0028622 3/2016

*Primary Examiner* — Olga V Merkoulova
(74) *Attorney, Agent, or Firm* — Lewis Roca Rothgerber Christie LLP

(57) ABSTRACT

A display device includes a display panel including a plurality of pixels, and a panel driver configured to receive input data, and to drive the display panel based on the input data. The panel driver includes a partial still image detector configured to detect a still image data portion in the input data by determining whether at least a portion of the input data represents a still image, and a command decoder configured to extract command data from the input data by decoding the still image data portion in which the command data are encoded.

18 Claims, 13 Drawing Sheets

(56) References Cited

U.S. PATENT DOCUMENTS

| | | | | |
|---|---|---|---|---|
| 8,508,557 | B2 * | 8/2013 | Park | G09G 3/3208 345/690 |
| 2002/0011998 | A1 * | 1/2002 | Tamura | G09G 3/3611 345/204 |
| 2002/0018058 | A1 * | 2/2002 | Tamura | G06F 3/147 345/204 |
| 2002/0113781 | A1 * | 8/2002 | Ishiyama | G09G 3/20 345/204 |
| 2006/0092149 | A1 * | 5/2006 | Morita | G09G 3/3688 345/204 |
| 2006/0125784 | A1 * | 6/2006 | Jang | G06F 1/1622 345/156 |
| 2006/0152463 | A1 * | 7/2006 | Furihata | G09G 3/3648 345/98 |
| 2010/0225565 | A1 * | 9/2010 | Freitas | G06F 3/14 345/2.1 |
| 2011/0156936 | A1 * | 6/2011 | Kim | H04L 25/14 341/100 |
| 2012/0194487 | A1 * | 8/2012 | Roethig | G06F 3/1423 345/204 |
| 2013/0044088 | A1 * | 2/2013 | Chang-Chian | G09G 3/20 345/204 |
| 2014/0168197 | A1 * | 6/2014 | Kobayashi | G09G 3/3648 345/212 |
| 2014/0313181 | A1 * | 10/2014 | Hong | G09G 3/3696 345/212 |
| 2016/0063948 | A1 * | 3/2016 | Han | G09G 5/003 345/213 |
| 2017/0242852 | A1 * | 8/2017 | Clain | G06F 9/451 |

* cited by examiner

DISPLAY DEVICE, METHOD OF RECEIVING IMAGE DATA AND COMMAND DATA, AND METHOD OF TRANSFERRING IMAGE DATA AND COMMAND DATA

CROSS-REFERENCE TO RELATED APPLICATION

This application claims priority to and the benefit of Korean Patent Application No. 10-2019-0175607, filed on Dec. 26, 2019 in the Korean Intellectual Property Office, the entire content of which is incorporated herein by reference.

BACKGROUND

1. Field

Example embodiments of the present inventive concept relate to a display device, a method of receiving image data and command data by a display device, and a method of transferring image data and the command data by a host processor.

2. Description of the Related Art

A display device may receive not only image data for displaying an image, but also command data for controlling the display device from a host processor (e.g., an application processor (AP), a graphic processing unit (GPU), or the like). To transfer the command data between the host processor and the display device, an additional wiring should be disposed between the host processor and the display device, or an interface mode between the host processor and the display device should be changed from a first interface mode (e.g., a video mode of a mobile industry processor interface (MIPI)) for transferring the image data to a second interface mode (e.g., a command mode of the MIPI) for transferring the command data.

SUMMARY

According to an aspect of one or more embodiments, a display device capable of efficiently receiving image data and command data is provided.

According to an aspect of one or more embodiments, a method of receiving image data and command data by a display device is provided.

According to an aspect of one or more embodiments, a method of transferring image data and command data by a host processor is provided.

According to one or more embodiments, a display device includes a display panel including a plurality of pixels, and a panel driver configured to receive input data, and to drive the display panel based on the input data. The panel driver includes a partial still image detector configured to detect a still image data portion in the input data by determining whether at least a portion of the input data represents a still image, and a command decoder configured to extract command data from the input data by decoding the still image data portion in which the command data are encoded.

In one or more embodiments, when the portion of the input data in a second frame is the same as the portion of the input data in a first frame, the partial still image detector is configured to detect the portion of the input data as the still image data portion.

In one or more embodiments, the panel driver may be configured to receive the input data including the still image data portion in which the command data are encoded in one or more subsequent frames, and to decode the still image data portion in which the command data are encoded, and the command decoder may be configured to calculate a difference between the still image data portion in the second frame and the still image data portion in which the command data are encoded in each of the one or more subsequent frames.

In one or more embodiments, the one or more subsequent frames may include a third frame, one or more fourth frames, and a fifth frame, a start pattern may be encoded as the command data in the still image data portion in the third frame, command data bits may be encoded as the command data in the still image data portion in each of the one or more fourth frames, and an error correction code may be encoded as the command data in the still image data portion in the fifth frame.

In one or more embodiments, the one or more subsequent frames may include a third frame, one or more fourth frames, and a fifth frame, a start pattern and command data bits may be encoded as the command data in the still image data portion in the third frame, the command data bits may be encoded as the command data in the still image data portion in each of the one or more fourth frames, and the command data bits and an error correction code may be encoded as the command data in the still image data portion in the fifth frame.

In one or more embodiments, the one or more subsequent frames may be a single frame, and a start pattern, command data bits, and an error correction code may be encoded as the command data in the still image data portion in the single frame.

In one or more embodiments, the command data may be encoded in the still image data portion such that values of the command data are respectively added to sub-pixel image data included in the still image data portion.

In one or more embodiments, the command data may be encoded in the still image data portion such that a same one of values of the command data is added to sub-pixel image data of each pixel image data included in the still image data portion.

In one or more embodiments, the command data may be encoded in the still image data portion such that the command data are added to the still image data portion, and values of the command data added to the still image data portion are within a command data bit range.

In one or more embodiments, the panel driver may further include a driving frequency decider configured to determine a driving frequency for a partial panel region of the display panel corresponding to the still image data portion as a low frequency lower than a normal driving frequency by analyzing the still image data portion when the still image data portion is detected.

In one or more embodiments, the still image data portion in which the command data are encoded may correspond to image data for a partial panel region of the display panel, and the partial panel region is configured to display the still image, and has a fixed position.

In one or more embodiments, the partial still image detector may include a representative value register configured to store a previous representative value of the portion of the input data in a previous frame before the still image data portion is detected, and to store a still image representative value of the still image data portion after the still image data portion is detected, and a still image detecting block configured to calculate a current representative value of the portion of the input data in a current frame, to determine whether the portion of the input data represents the still image by comparing the current representative value with the previous representative value before the still image data portion is detected, and to determine whether the portion of the input data represents the still image by determining whether a difference between the current representative value and the still image representative value is within a reference representative value range corresponding to a command data bit range after the still image data portion is detected.

In one or more embodiments, the panel driver may further include a data portion storage configured to store the portion of the input data in a previous frame before the still image data portion is detected, and to store the still image data portion after the still image data portion is detected. The partial still image detector may include a still image detecting block configured to determine whether the portion of the input data represents the still image by comparing the portion of the input data in a current frame with the portion of the input data in the previous frame stored in the data portion storage before the still image data portion is detected, and to determine whether the portion of the input data represents the still image by determining whether a difference between the portion of the input data in the current frame and the still image data portion stored in the data portion storage is within a command data bit range after the still image data portion is detected.

In one or more embodiments, the command decoder may be configured to extract the command data from the input data by subtracting the still image data portion stored in the data portion storage from the portion of the input data in the current frame.

In one or more embodiments, the input data may be divided into a plurality of partial input data respectively corresponding to a plurality of partial panel regions of the display panel, and the still image data portion in which the command data are encoded is selected from among the plurality of partial input data representing the still image.

In one or more embodiments, partial input data representing a highest gray level from among the plurality of partial input data representing the still image may be selected as the still image data portion in which the command data are encoded.

In one or more embodiments, the partial still image detector may include a data dividing block configured to divide the input data into a plurality of partial input data respectively corresponding to a plurality of partial panel regions of the display panel, a plurality of representative value registers for the plurality of partial input data, each of the plurality of representative value registers configured to store a previous representative value of corresponding partial input data from among the plurality of partial input data in a previous frame before the corresponding partial input data are detected as the still image data portion, and to store a still image representative value of the still image data portion after the corresponding partial input data are detected as the still image data portion, and a still image detecting block configured to calculate a current representative value of each of the plurality of partial input data in a current frame, to determine whether the corresponding partial input data represent the still image by comparing the current representative value of the corresponding partial input data with the previous representative value before the corresponding partial input data are detected as the still image data portion, and to determine whether the corresponding partial input data represent the still image by determining whether a difference between the current representative value of the corresponding partial input data and the still image representative value is within a reference representative value range corresponding to a command data bit range after the corresponding partial input data are detected as the still image data portion.

In one or more embodiments, the input data may be divided into a plurality of partial input data respectively corresponding to a plurality of partial panel regions of the display panel. The panel driver may further include a frame data storage configured to store each of the plurality of partial input data in a previous frame before each of the plurality of partial input data is detected as the still image data portion, and to store the still image data portion after each of the plurality of partial input data is detected as the still image data portion. The partial still image detector may include a data dividing block configured to divide the input data into the plurality of partial input data, and a still image detecting block configured to determine whether each of the plurality of partial input data represents the still image by comparing each of the plurality of partial input data in a current frame with each of the plurality of partial input data in the previous frame stored in the frame data storage before each of the plurality of partial input data is detected as the still image data portion, and to determine whether each of the plurality of partial input data represents the still image by determining whether a difference between each of the plurality of partial input data in the current frame and the still image data portion stored in the frame data storage is within a command data bit range after each of the plurality of partial input data is detected as the still image data portion.

According to one or more embodiments, a method of receiving image data and command data by a display device is provided. In the method, input data including the image data are received, a still image data portion is detected in the input data by determining whether at least a portion of the input data represents a still image, the still image data portion is stored, the input data including the image data in which the command data are encoded in the still image data portion are received, and the command data are extracted from the input data by calculating a difference between the stored still image data portion and the still image data portion in which the command data are encoded.

According to one or more embodiments, a method of transferring image data and command data to a display device by a host processor is provided. In the method, input data including the image data are transferred to the display device, a still image data portion is identified in the input data, the command data are encoded in the still image data portion, and the input data including the image data in which the command data are encoded in the still image data portion are transferred to the display device.

As described above, in a display device, a method of receiving image data and command data by a display device, and a method of transferring image data and command data by a host processor according to some embodiments, a still image data portion may be detected in input data, and the command data may be extracted from the input data by decoding the still image data portion. Accordingly, even if an interface mode between the host processor and the display device is not changed, the command data may be transferred and received along with the image data.

BRIEF DESCRIPTION OF THE DRAWINGS

Aspects of embodiments will be more clearly understood from the following detailed description of some illustrative, non-limiting example embodiments in conjunction with the accompanying drawings.

DETAILED DESCRIPTION

Figure 1:
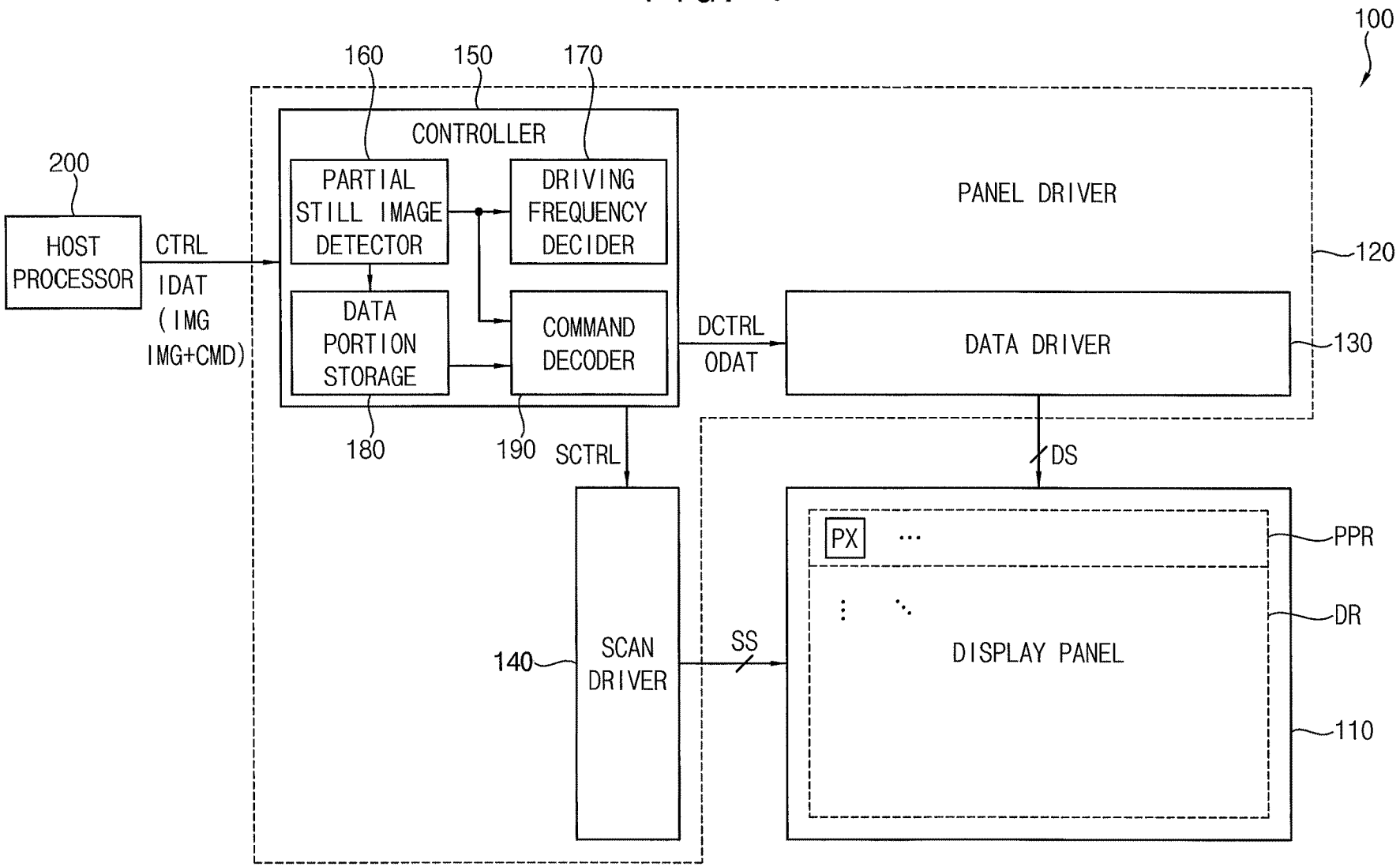
FIG. 1 is a block diagram illustrating a display device according to one or more example embodiments.

Herein, embodiments of the present inventive concept will be explained in further detail with reference to the accompanying drawings. The inventive concepts may, however, be embodied in many different forms, and should not be construed as limited to the embodiments set forth herein.

In the present disclosure, it is to be understood that when an element or layer is referred to as being "on," "connected to," or "coupled to" another element or layer, it may be directly on, connected, or coupled to the other element or layer, or one or more intervening elements or layers may be present.

Like numerals refer to like elements throughout. In the drawings, the thickness, ratio, and dimensions of components may be exaggerated for ease of description of the technical content.

As used herein, the term "and/or" includes any and all combinations of one or more of the associated listed items.

It is to be understood that, although the terms "first," "second," etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a "second" element, component, region, layer, or section without departing from the teachings of the present disclosure. As used herein, the singular forms, "a," "an," and "the" are intended to include the plural forms as well, unless the context clearly indicates otherwise.

Spatially relative terms, such as "beneath," "below," "lower," "above," "upper," and the like, may be used herein for ease of description to describe one element or feature's relationship to another element(s) or feature(s) as illustrated in the figures.

Unless otherwise defined, all terms (including technical and scientific terms) used herein have the same meaning as commonly understood by one of ordinary skill in the art to which this disclosure belongs. It is to be further understood that terms, such as those defined in commonly used dictionaries, should be interpreted as having a meaning that is consistent with their meaning in the context of the relevant art and are not to be interpreted in an idealized or overly formal sense unless expressly so defined herein.

Figure 2A:
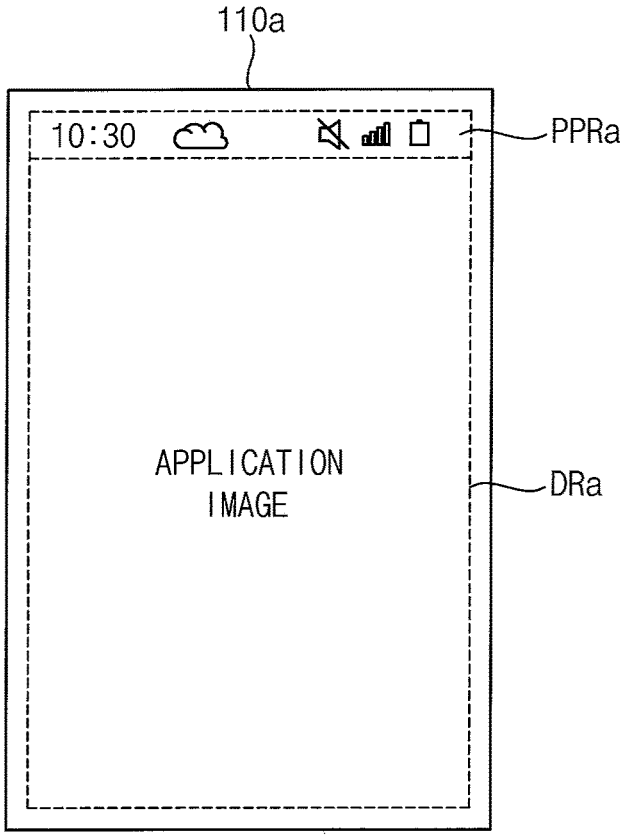
FIG. 2A is a diagram for describing an example of a partial panel region corresponding to a still image data portion in which command data are encoded.
Figure 2B:
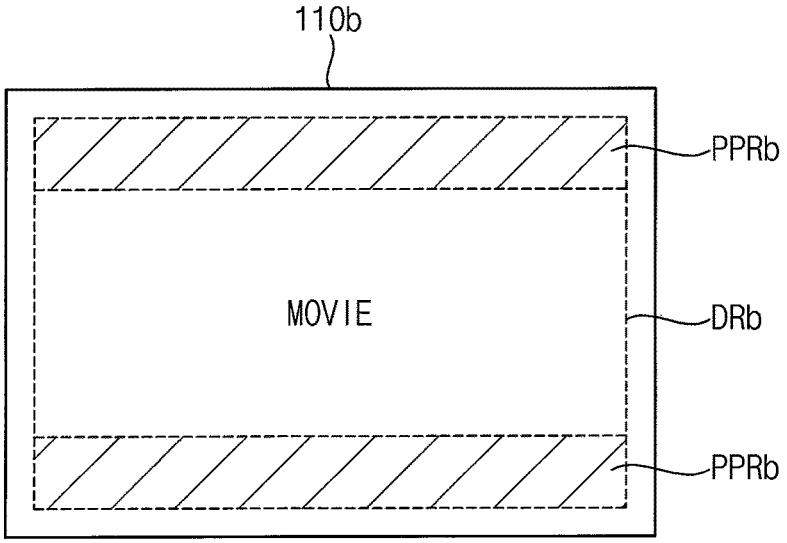
FIG. 2B is a diagram for describing another example of a partial panel region corresponding to a still image data portion in which command data are encoded.
Figure 3:
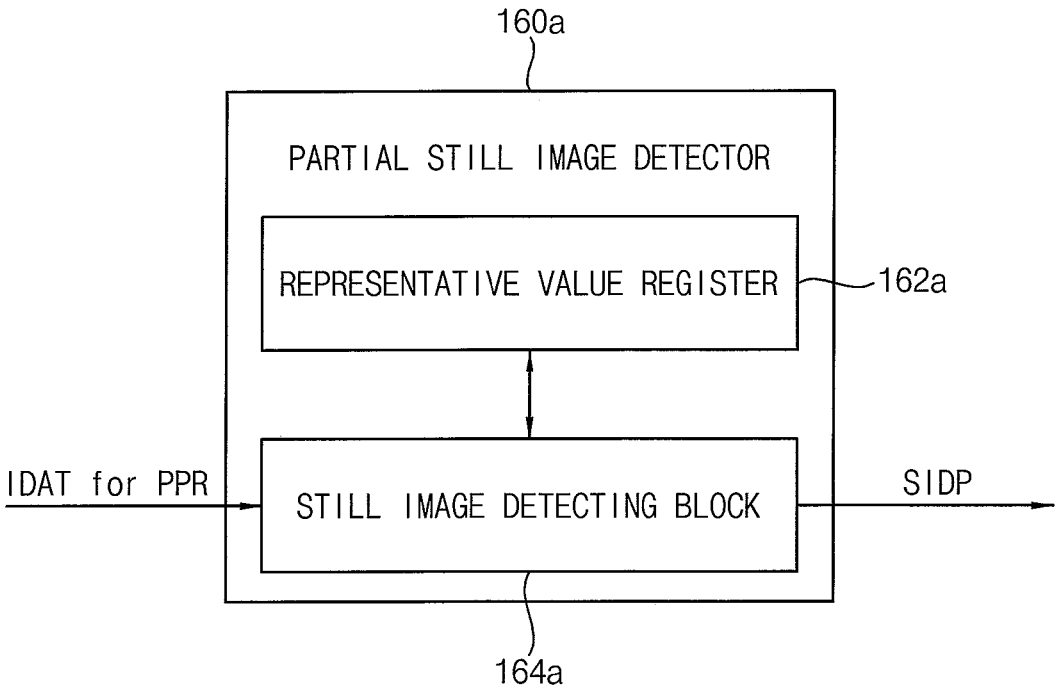
FIG. 3 is a block diagram illustrating an example of a partial still image detector included in a display device according to one or more example embodiments.
Figure 4:
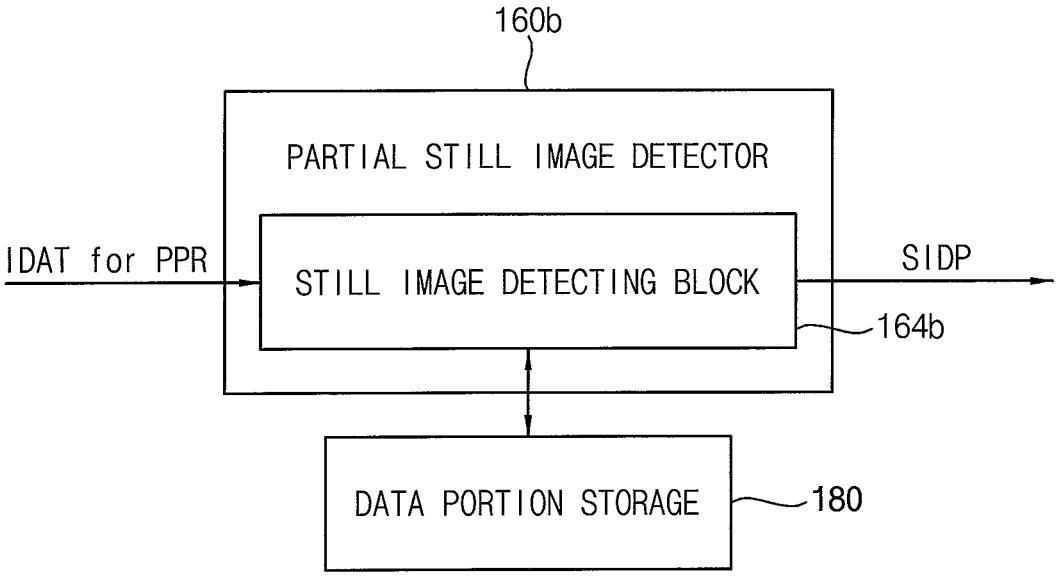
FIG. 4 is a block diagram illustrating another example of a partial still image detector included in a display device according to one or more example embodiments.
Figure 5:
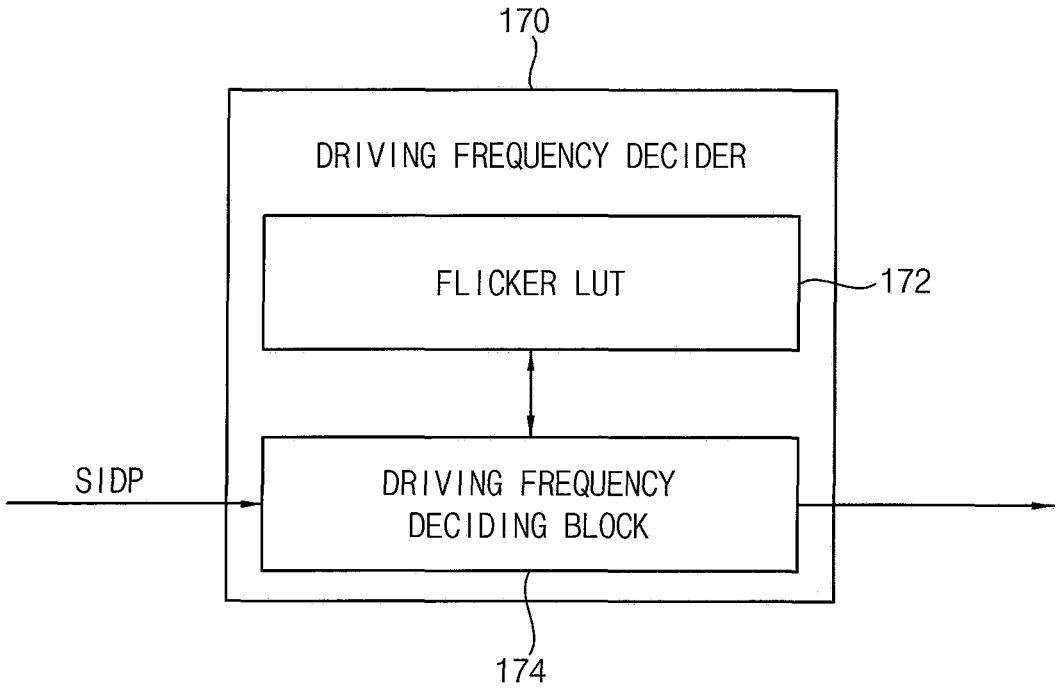
FIG. 5 is a block diagram illustrating an example of a driving frequency decider included in a display device according to one or more example embodiments.
Figure 6:
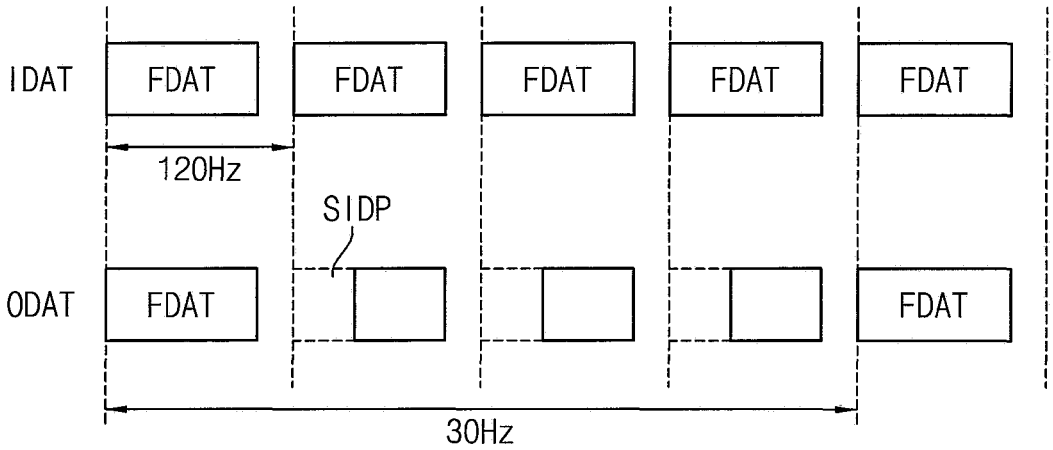
FIG. 6 is a timing diagram for describing an example in which a partial panel region is driven at a low driving frequency lower than a normal driving frequency in a display device according to one or more example embodiments.
Figure 7:
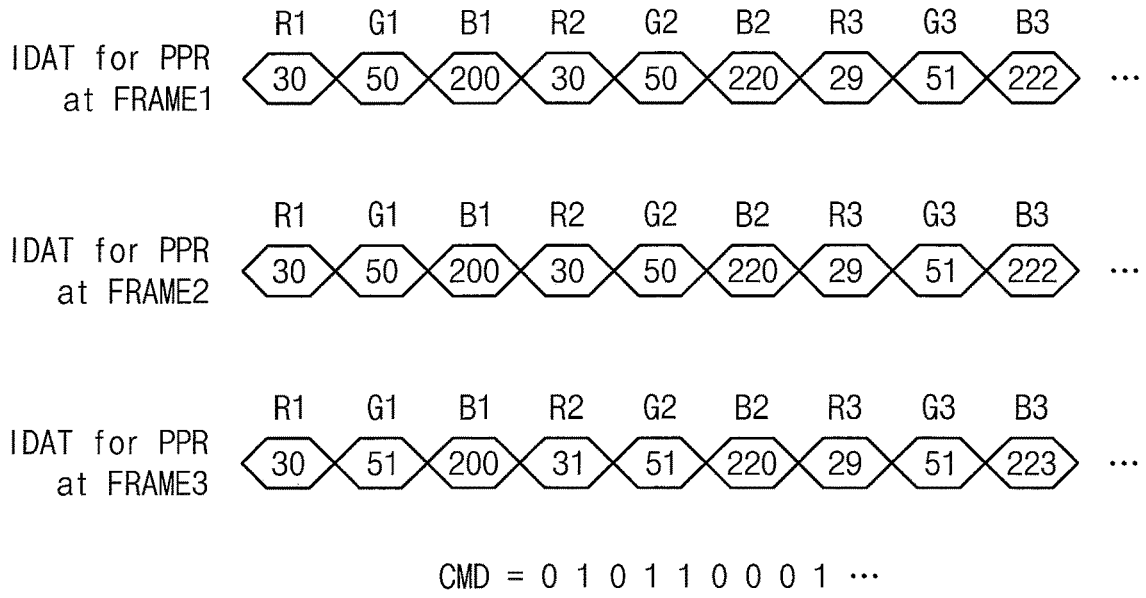
FIG. 7 is a diagram for describing an example of a still image data portion in which command data are encoded according to one or more example embodiments.
Figure 8:
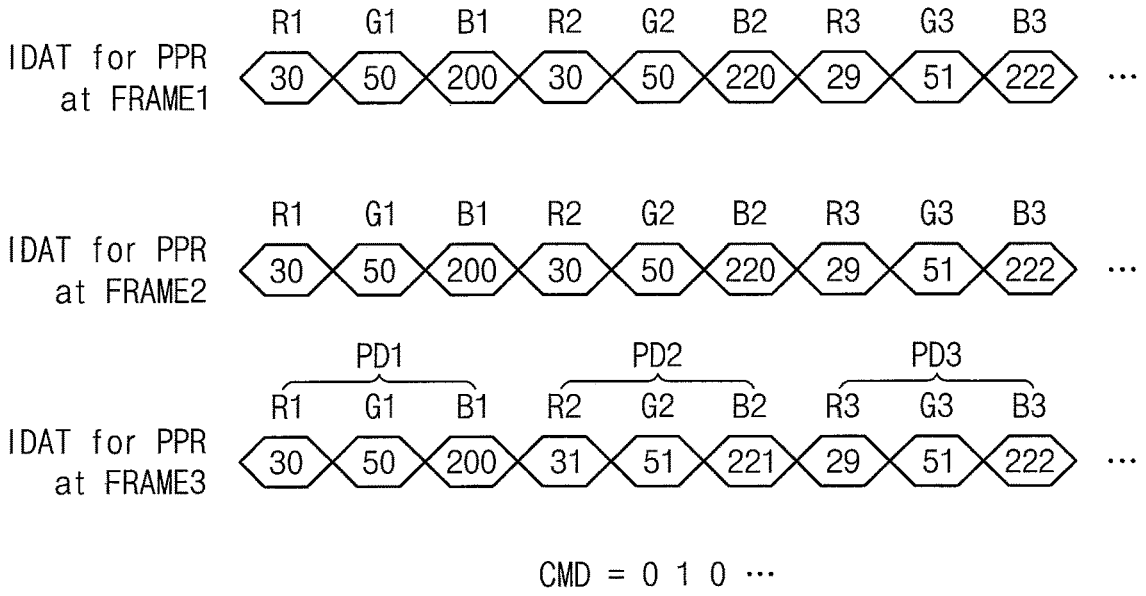
FIG. 8 is a diagram for describing another example of a still image data portion in which command data are encoded according to one or more example embodiments.

FIG. 1 is a block diagram illustrating a display device according to one or more example embodiments; FIG. 2A is a diagram for describing an example of a partial panel region corresponding to a still image data portion in which command data are encoded; FIG. 2B is a diagram for describing another example of a partial panel region corresponding to a still image data portion in which command data are encoded; FIG. 3 is a block diagram illustrating an example of a partial still image detector included in a display device according to one or more example embodiments; FIG. 4 is a block diagram illustrating another example of a partial still image detector included in a display device according to one or more example embodiments; FIG. 5 is a block diagram illustrating an example of a driving frequency decider included in a display device according to one or more example embodiments; FIG. 6 is a timing diagram for describing an example in which a partial panel region is driven at a low driving frequency lower than a normal driving frequency in a display device according to one or more example embodiments; FIG. 7 is a diagram for describing an example of a still image data portion in which command data are encoded according to one or more example embodiments; and FIG. 8 is a diagram for describing another example of a still image data portion in which command data are encoded according to one or more example embodiments.

Referring to FIG. 1, a display device 100 according to one or more example embodiments may include a display panel 110 that includes a plurality of pixels PX, and a panel driver 120 that receives input data IDAT and drives the display panel 110 based on the input data IDAT. In some example embodiments, the panel driver 120 may include a data driver 130 that provides data signals DS to the plurality of pixels PX, a scan driver 140 that provides scan signals SS to the plurality of pixels PX, and a controller 150 that controls the data driver 130 and the scan driver 140.

The display panel 110 may include a plurality of data lines, a plurality of scan lines, and the plurality of pixels PX coupled to the plurality of data lines and the plurality of scan lines. In some example embodiments, each pixel PX may include at least one capacitor, at least two transistors and an organic light emitting diode (OLED), and the display panel 110 may be an OLED display panel. In an example embodiment, each pixel PX may be, but is not limited to, a hybrid pixel suitable for low frequency driving for reducing power consumption, which includes at least one low-temperature polycrystalline silicon (LTPS) PMOS transistor and at least one oxide NMOS transistor.

In other example embodiments, the display panel 110 may be a liquid crystal display (LCD) panel, or any other suitable display panel.

In some example embodiments, a partial panel region PPR having a predetermined or fixed position which is a portion of a display region DR of the display panel 110 may be expected to display a still image mainly (e.g., for more than a certain time from among a time driving time of the display device 100). For example, as illustrated in FIG. 2A, in a case in which a system application or a user application is executed, a display region DRa of a display panel 110*a* may display an application image, and a partial panel region PPRa at the top of the display region DRa may display a status bar representing a time, a weather, a speaker status, a communication status, a battery status, etc. The status bar displayed in the partial panel region PPRa may correspond to the still image, except when a status (e.g., the time) is changed. Thus, in the example of FIG. 2A, the partial panel region PPRa at the top of the display region DRa may be expected to mainly display the still image. In another example, as illustrated in FIG. 2B, in a case in which a video application is executed, a display region DRb of a display panel 110*b* may display a movie image, and a partial panel region PPRb at the top and the bottom of the display region DRb may display a black image that is the still image. Thus, in the example of FIG. 2B, the partial panel region PPRb at the top and the bottom of the display region DRb may be expected to mainly display the still image. Although FIGS. 2A and 2B illustrate examples in which the partial panel region PPRa at the top of the display region DRa and the partial panel region PPRb at the top and the bottom of the display region DRb are expected to mainly display the still image, the partial panel region PPR expected to mainly display the still image in the display device 100 according to example embodiments is not limited to the examples of FIGS. 2A and 2B. In other example embodiments, as described below with reference to FIGS. 14 through 17, the partial panel region PPR displaying the still image may not have the predetermined or fixed position, and may have any position in the display region DR.

The data driver 130 may generate the data signals DS based on output data ODAT and a data control signal DCTRL received from the controller 150, and may provide the data signals DS to the plurality of pixels PX through the plurality of data lines. In some example embodiments, the data control signal DCTRL may include, but is not limited to, an output data enable signal, a horizontal start signal, and a load signal. In some example embodiments, the data driver 130 and the controller 150 may be implemented with a single integrated circuit, and the integrated circuit may be referred to as a timing controller embedded data driver (TED). In other example embodiments, the data driver 130 and the controller 150 may be implemented with separate integrated circuits.

The scan driver 140 may generate the scan signals SS based on a scan control signal SCTRL received from the controller 150, and may sequentially provide the scan signals SS to the plurality of pixels PX through the plurality of scan lines on a row-by-row basis. In some example embodiments, the scan control signal SCTRL may include, but is not limited to, a scan start signal and a scan clock signal. In some example embodiments, the scan driver 140 may be integrated or formed in a peripheral region of the display panel 110 adjacent to the display region DR of the display panel 110. In other example embodiments, the scan driver 140 may be implemented in the form of an integrated circuit.

The controller 150 (e.g., a timing controller (TCON)) may receive input data IDAT and a control signal CTRL from an external host processor 200 (e.g., an application processor (AP), a graphic processing unit (GPU) or a graphic card). In some example embodiments, the control signal CTRL may include, but is not limited to, a vertical synchronization signal, a horizontal synchronization signal, an input data enable signal, a master clock signal, etc. The controller 150 may generate the output data ODAT, the data control signal DCTRL and the scan control signal SCTRL based on the input data IDAT and the control signal CTRL. The controller 150 may control an operation of the data driver 130 by providing the output data ODAT and the data control signal DCTRL to the data driver 130, and may control an operation of the scan driver 140 by providing the scan control signal SCTRL to the scan driver 140.

When at least a portion of the input data IDAT represents the still image, the display device 100 according to example embodiments may perform a low frequency driving operation (or a multi-frequency driving (MFD) operation) that drives at least a portion of the display region DR, or the partial panel region PPR at a low frequency lower than a normal driving frequency (e.g., about 60 Hz or about 120 Hz). To drive the partial panel region PPR at the low frequency, as illustrated in FIG. 1, the controller 150 may include a partial still image detector 160, a driving frequency decider 170, and a data portion storage 180.

The partial still image detector 160 may detect a still image data portion in the input data IDAT by determining whether the portion of the input data IDAT, or the input data IDAT for the partial panel region PPR represents the still image. For example, the partial still image detector 160 may detect the input data IDAT for the partial panel region PPR as the still image data portion by comparing the input data IDAT for the partial panel region PPR in a previous frame and the input data IDAT for the partial panel region PPR in a current frame.

In some example embodiments, as illustrated in FIG. 3, a partial still image detector 160*a* may include a representative value register 162*a* and a still image detecting block 164*a*. The representative value register 162*a* may store a previous representative value (e.g., an average value or a checksum) of the portion of the input data IDAT, or the input data IDAT for the partial panel region PPR in the previous frame. In some example embodiments, the representative value register 162*a* may store the previous representative value of the input data IDAT for the partial panel region PPR in the previous frame before the still image data portion SIDP is detected, or before the input data IDAT for the partial panel region PPR are determined to display the still image, and may store a still image representative value of the still image data portion SIDP after the still image data portion SIDP is detected, or after the input data IDAT for the partial panel region PPR are determined to display the still image.

The still image detecting block 164*a* may calculate a current representative value of the input data IDAT for the partial panel region PPR in the current frame, and may determine whether the input data IDAT for the partial panel region PPR represent the still image by comparing the calculated current representative value with the previous representative value stored in the representative value register 162*a*. When the current representative value is different from the previous representative value, the still image detecting block 164*a* may determine that the input data IDAT for the partial panel region PPR do not represent the still image. When the current representative value is the same (the same or substantially the same) as the previous representative value, the still image detecting block 164*a* may determine that the input data IDAT for the partial panel region PPR represent the still image, and may detect the input data IDAT for the partial panel region PPR as the still image data portion SIDP. Once the still image data portion SIDP is detected, the still image detecting block 164*a* may store the still image data portion SIDP in the data portion storage 180. In some example embodiments, the still image data portion SIDP stored in the data portion storage 180 may be used to drive the partial panel region PPR, and/or for a command decoder 190 to extract command data CMD from the input data IDAT.

In some example embodiments, the still image detecting block 164*a* may compare the current representative value with the previous representative value before the still image data portion SIDP is detected, and may compare the current representative value with the still image representative value after the still image data portion SIDP is detected. Further, after the still image data portion SIDP is detected, the still image detecting block 164*a* may determine whether the input data IDAT for the partial panel region PPR represent the still image according to whether a difference between the current representative value and the still image representative value is within a reference representative value range corresponding to a command data bit range. Thus, the still image detecting block 164*a* may determine that the input data IDAT for the partial panel region PPR represent the still image when the difference between the current representative value and the still image representative value is within the reference representative value range. Further, the still image detecting block 164*a* may determine that the input data IDAT for the partial panel region PPR do not represent the still image when the difference between the current representative value and the still image representative value is out of the reference representative value range. That is, after the still image data portion SIDP is detected, the still image detecting block 164*a* may determine whether the input data IDAT for the partial panel region PPR represent the still image by considering that not only image data IMG, but the image data IMG where the command data CMD are encoded are received as the input data IDAT. If the input data IDAT for the partial panel region PPR are determined not to represent the still image after the input data IDAT for the partial panel region PPR are detected as the still image data portion SIDP, the partial panel region PPR driven at the low frequency may be driven again at the normal driving frequency.

In other example embodiments, as illustrated in FIG. 4, a partial still image detector 160*b* may determine whether the input data IDAT for the partial panel region PPR represent the still image by using the data portion storage 180, and may include a still image detecting block 164*b*. The data portion storage 180 may store the portion of the input data IDAT, or the input data IDAT for the partial panel region PPR in the previous frame before the still image data portion SIDP is detected, and may store the still image data portion SIDP after the still image data portion SIDP is detected.

The still image detecting block 164*b* may determine whether the input data IDAT for the partial panel region PPR represent the still image by comparing the input data IDAT for the partial panel region PPR in the current frame with the input data IDAT for the partial panel region PPR in the previous frame stored in the data portion storage 180 before the still image data portion SIDP is detected. When the input data IDAT for the partial panel region PPR in the current frame are different from the input data IDAT for the partial panel region PPR in the previous frame, the still image detecting block 164*b* may determine that the input data IDAT for the partial panel region PPR do not represent the still image. When the input data IDAT for the partial panel region PPR in the current frame are the same (the same or substantially the same) as the input data IDAT for the partial panel region PPR in the previous frame, the still image detecting block 164*b* may determine that the input data IDAT for the partial panel region PPR represent the still image, and may detect the input data IDAT for the partial panel region PPR as the still image data portion SIDP. Once the still image data portion SIDP is detected, the still image detecting block 164*b* may store the still image data portion SIDP in the data portion storage 180.

After the still image data portion SIDP is detected, the still image detecting block 164*b* may compare the input data IDAT for the partial panel region PPR in the current frame with the still image data portion SIDP stored in the data portion storage 180, and may determine whether the input data IDAT for the partial panel region PPR represent the still image by determining whether a difference between the input data IDAT for the partial panel region PPR and the still image data portion SIDP is within the command data bit range. Thus, the still image detecting block 164*b* may determine that the input data IDAT for the partial panel region PPR represent the still image when the difference between the input data IDAT for the partial panel region PPR and the still image data portion SIDP is within the command data bit range. Further, the still image detecting block 164*b* may determine that the input data IDAT for the partial panel region PPR do not represent the still image when the difference between the input data IDAT for the partial panel region PPR and the still image data portion SIDP is out of the command data bit range. That is, after the still image data portion SIDP is detected, the still image detecting block 164*b* may determine whether the input data IDAT for the partial panel region PPR represent the still image by considering that not only the image data IMG, but the image data IMG in which the command data CMD are encoded are received as the input data IDAT.

The driving frequency decider 170 may determine a driving frequency for the partial panel region PPR corresponding to the still image data portion SIDP as the low frequency lower than the normal driving frequency by analyzing the still image data portion SIDP when the still image data portion SIDP is detected. For example, the normal driving frequency may be a predetermined or fixed frequency of about 60 Hz or about 120 Hz, but the normal driving frequency is not limited to about 60 Hz or about 120 Hz. Further, the low frequency may be any frequency lower than the normal driving frequency.

In some example embodiments, as illustrated in FIG. 5, the driving frequency decider 170 may include a flicker lookup table (LUT) 172 and a driving frequency deciding block 174. The flicker LUT 172 may store flicker values corresponding to image data gray levels (e.g., 256 gray levels from a 0-gray level to a 255-gray level). Here, the flicker value may represent a level or an amount of a flicker perceived by a user. The driving frequency deciding block 174 may determine a flicker value corresponding to a gray level of the still image data portion SIDP by using the flicker LUT 172, and may decide the driving frequency for the partial panel region PPR corresponding to the still image data portion SIDP according to the flicker value. According to example embodiments, determining the flicker value and the driving frequency may be performed on a pixel-by-pixel basis, on a segment-by-segment basis, or on the partial panel region PPR. For example, the still image data portion SIDP may be divided into a plurality of segment data for a plurality of segments, segment flicker values for the plurality of segments may be determined by using the flicker LUT 172, segment driving frequencies for the plurality of segments may be determined according to the segment flicker values, and a maximum one of the segment driving frequencies may be determined as the driving frequency for the partial panel region PPR corresponding to the still image data portion SIDP.

If the driving frequency for the partial panel region PPR is determined as the low frequency by the driving frequency decider 170, the controller 150 may control the data driver 130 and the scan driver 140 to drive the partial panel region PPR at the low frequency. For example, as illustrated in FIG. 6, in a case in which a driving frequency of the display region DR except for the partial panel region PPR is determined as the normal driving frequency of about 120 Hz, and the driving frequency for the partial panel region PPR is determined as the low frequency of about 30 Hz, the controller 150 may receive four frame data FDAT as the input data IDAT, may provide one entire frame data FDAT as the output data ODAT to the data driver 130, and may further provide three partial frame data in which the still image data portion SIDP are removed as the output data ODAT to the data driver 130. Accordingly, the data driver 130 may provide the data signals DS to the entire display region DR in one frame from among four frames, may provide the data signals DS only to the display region DR except for the partial panel region PPR in each of three frames from among the four frames, and may not provide the data signals DS to the partial panel region PPR in each of the three frames. Further, the scan driver 140 may not provide the scan signals SS to the partial panel region PPR in each of the three frames from among the four frames. Accordingly, the display region DR except for the partial panel region PPR may be driven at the normal driving frequency of about 120 Hz, and the partial panel region PPR may be driven at the low frequency of about 30 Hz.

The display device 100 according to example embodiments may receive the input data IDAT including only the image data IMG from the host processor 200, or may receive the input data IDAT in which the command data CMD are encoded in the image data IMG from the host processor 200. In some example embodiments, the host processor 200 may encode the command data CMD in the still image data portion SIDP for the partial panel region PPR displaying the still image from among the image data IMG for the display region, and the display device 100 may receive the input data IDAT in which the command data CMD are encoded in the still image data portion SIDP from the host processor 200. Here, the command data CMD may be data for controlling the display device 100 or the panel driver 120. For example, the command data CMD may be, but is not limited to, data for a voltage change, a touch ON/OFF operation, a sensor update, etc. To extract the command data CMD from the input data IDAT in which the command data CMD are encoded in the still image data portion SIDP, the controller 150 may include the command decoder 190.

The command decoder 190 may extract the command data CMD from the input data IDAT by decoding the still image data portion SIDP in which the command data CMD are encoded. In some example embodiments, to decode the still image data portion SIDP in which the command data CMD are encoded, the command decoder 190 may calculate a difference between the input data IDAT for the partial panel region PPR (or the still image data portion SIDP in which the command data CMD are encoded) and the still image data portion SIDP stored in the data portion storage 180. For example, the command decoder 190 may extract the command data CMD from the input data IDAT by subtracting the still image data portion SIDP stored in the data portion storage 180 from the input data IDAT for the partial panel region PPR in the current frame.

For example, as illustrated in FIG. 7, the host processor 200 may transfer the same input data IDAT with respect to the partial panel region PPR in first and second frames FRAME1 and FRAME2. For example, as the input data IDAT for the partial panel region PPR, the host processor 200 may transfer the input data IDAT including sub-pixel image data R1, G1, B1, R2, G2, B2, R3, G3, B3, . . . representing 30, 50, 200, 30, 50, 220, 29, 51, 222, . . . in the first frame FRAME1, and may transfer the same input data IDAT including the sub-pixel image data R1, G1, B1, R2, G2, B2, R3, G3, B3, . . . representing 30, 50, 200, 30, 50, 220, 29, 51, 222, . . . in the second frame FRAME2. The partial still image detector 160 of the display device 100 may detect the input data IDAT for the partial panel region PPR in the second frame FRAME2 as the still image data portion SIDP when the input data IDAT for the partial panel region PPR in the second frame FRAME2 are the same (the same or substantially the same) as the input data IDAT for the partial panel region PPR in the first frame FRAME1.

The host processor 200 may transfer the input data IDAT in which the command data CMD are encoded in the still image data portion SIDP in a subsequent third frame FRAME3. In some example embodiments, to encode the command data CMD in the still image data portion SIDP, the host processor 200 may add the command data CMD to the still image data portion SIDP. For example, in a case in which the command data CMD represent 0, 1, 0, 1, 1, 0, 0, 0, 1, . . . , the host processor 200 may add the command data CMD representing 0, 1, 0, 1, 1, 0, 0, 0, 1, . . . to the still image data portion SIDP representing 30, 50, 200, 30, 50, 220, 29, 51, 222, . . . , and may transfer, as the input data IDAT for the partial panel region PPR, the input data IDAT representing 30, 51, 200, 31, 51, 220, 29, 51, 223, . . . . The panel driver 120 of the display device 100 may receive the input data IDAT in which the command data CMD are encoded in the still image data portion SIDP in the third frame FRAME3. The command decoder 190 may extract the command data CMD representing 0, 1, 0, 1, 1, 0, 0, 0, 1, . . . by subtracting the still image data portion SIDP stored in the data portion storage 180 (or the still image data portion SIDP in the second frame FRAME2), or the still image data portion SIDP representing 30, 50, 200, 30, 50, 220, 29, 51, 222, . . . from the still image data portion SIDP in which the command data CMD are encoded, or the input data IDAT representing 30, 51, 200, 31, 51, 220, 29, 51, 223, . . . . Accordingly, the command data CMD may be transferred even if an interface mode between the host processor 200 and the display device 100 is not changed, and the command data CMD may be transferred along with the image data IMG. In some example embodiments, although the input data IDAT for the partial panel region PPR in which the command data CMD are encoded are different from the still image data portion SIDP, the panel driver 120 may drive the partial panel region PPR based on the still image data portion SIDP stored in the data portion storage 180, and, thus, the still image displayed in the partial panel region PPR may not be distorted.

In some example embodiments, as illustrated in FIG. 7, the command data CMD may be encoded in the still image data portion SIDP such that values of the command data CMD are respectively added to the sub-pixel image data R1, G1, B1, R2, G2, B2, R3, G3, B3, . . . included in the still image data portion SIDP. In other example embodiments, as illustrated in FIG. 8, the command data CMD may be encoded in the still image data portion SIDP such that the same value or a single value (e.g., 0) of values of the command data CMD is added to the sub-pixel image data (e.g., R1, G1, and B1) of each pixel image data (e.g., PD1) included in the still image data portion SIDP. For example, as illustrated in FIG. 8, to encode the command data CMD representing 0, 1, 0, . . . in the still image data portion SIDP representing 30, 50, 200, 30, 50, 220, 29, 51, 222, . . . , a value of 0 of the command data CMD may be added to each of red, green, and blue sub-pixel image data R1, G1, and B1 of first pixel image data PD1, a value of 1 of the command data CMD may be added to each of red, green, and blue sub-pixel image data R2, G2, and B2 of second pixel image data PD2, and a value of 0 of the command data CMD may be added to each of red, green, and blue sub-pixel image data R3, G3, and B3 of third pixel image data PD3. Accordingly, the input data DAT in which the command data CMD are encoded in the still image data portion SIDP may represent 30, 50, 200, 31, 51, 221, 29, 51, 222, . . . . In this case, since the same value is encoded or added to the respective sub-pixel image data (e.g., R1, G1, and B1) of each pixel image data (e.g., PD1), a data distortion caused by a transfer loss, etc. may be reduced. In still other example embodiments, the same value of the command data CMD may be encoded or added to the respective sub-pixel image data of two or more pixel image data.

In some example embodiments, the values of the command data CMD added to the still image data portion SIDP may be within a command data bit range (e.g., a predetermined command data bit range). For example, as illustrated in FIGS. 7 and 8, the values of the command data CMD may be within the command data bit range of 0 and 1. In another example, the values of the command data CMD may be within the command data bit range of −1, 0, and 1. In still another example, the command data bit range may be, but is not limited to, from −2 to 2, from −4 to 4, from −8 to 8, or from −16 to 16. Since the command data CMD have the values within the command data bit range, even if the still image data portion SIDP in which the command data CMD are encoded are undesirably or erroneously determined not to represent the still image, and the partial panel region PPR is driven based on not the still image data portion SIDP stored in the data portion storage 180, but the still image data portion SIDP in which the command data CMD are encoded, a difference between an image corresponding to the still image data portion SIDP in which the command data CMD are not encoded and an image corresponding to the still image data portion SIDP in which the command data CMD are encoded may not be perceived by a user.

As described above, in the display device 100 according to example embodiments, the partial still image detector 160 may detect the still image data portion SIDP in the input data IDAT. If the input data IDAT in which the command data CMD are encoded in the still image data portion SIDP are received, the command decoder 190 may extract the command data CMD from the input data IDAT by decoding the still image data portion SIDP in which the command data CMD are encoded. Accordingly, even if an interface mode between the host processor 200 and the display device 100 is not changed (e.g., to a command mode of a mobile industry processor interface (MIPI)), the display device 100 according to example embodiments may receive the command data CMD along with the image data IMG.

Figure 9:
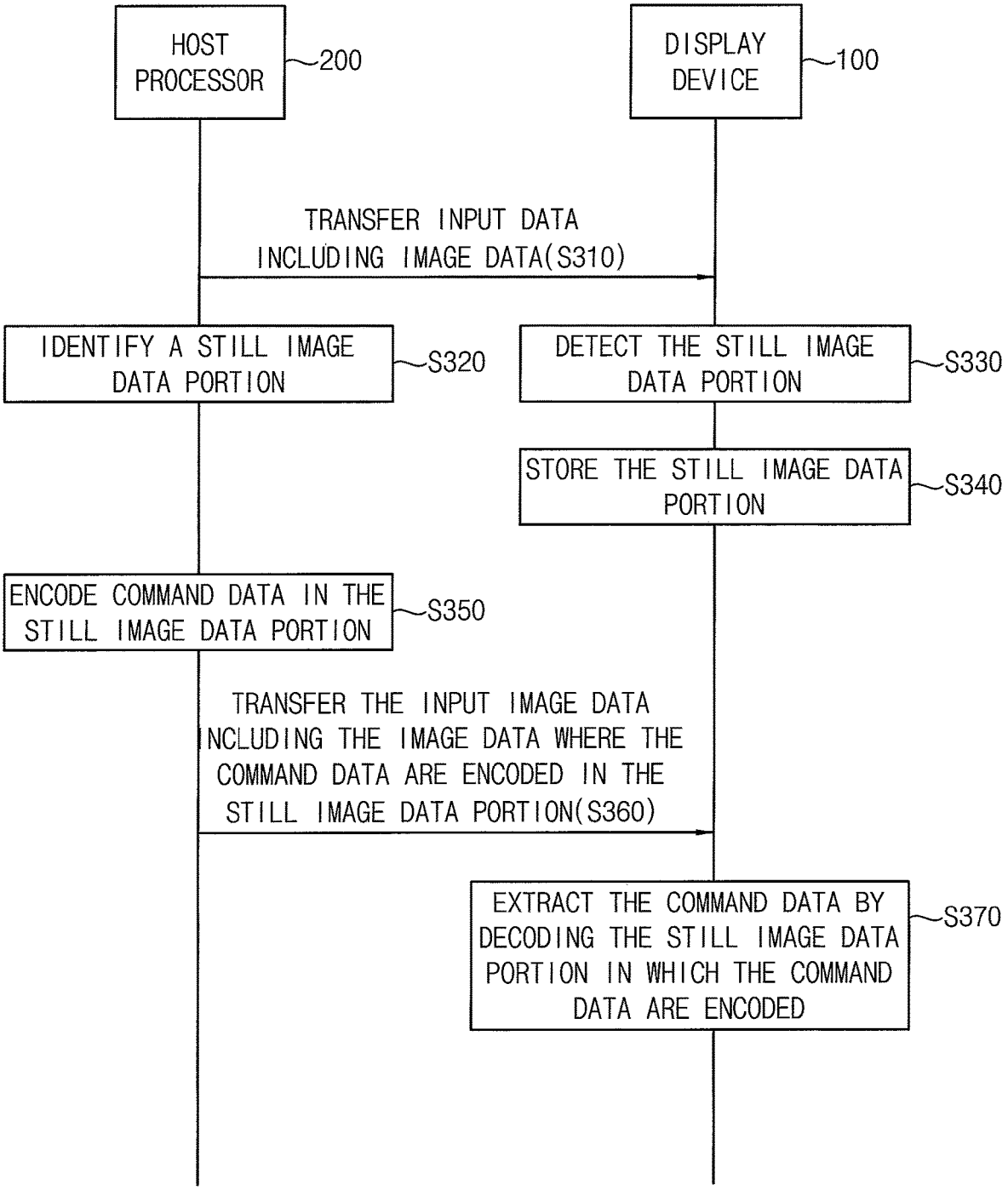
FIG. 9 is a flowchart illustrating a method of transferring image data and command data by a host processor and a method of receiving the image data and the command data by a display device according to one or more example embodiments.
Figure 10:
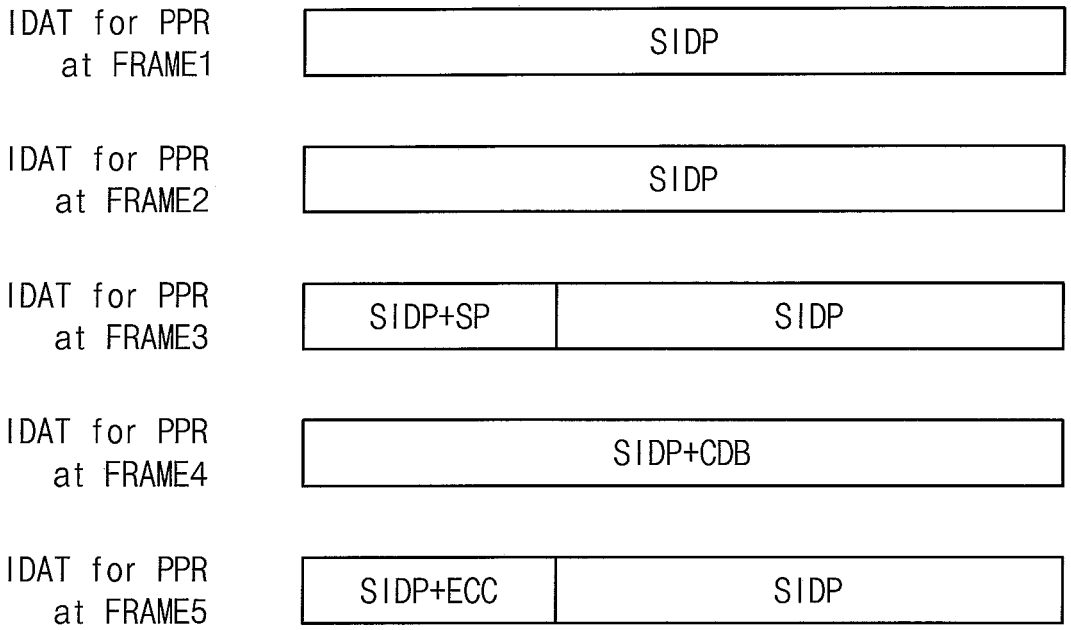
FIG. 10 is a diagram illustrating an example of input data for a partial panel region transferred between a host processor and a display device according to one or more example embodiments.
Figure 11:
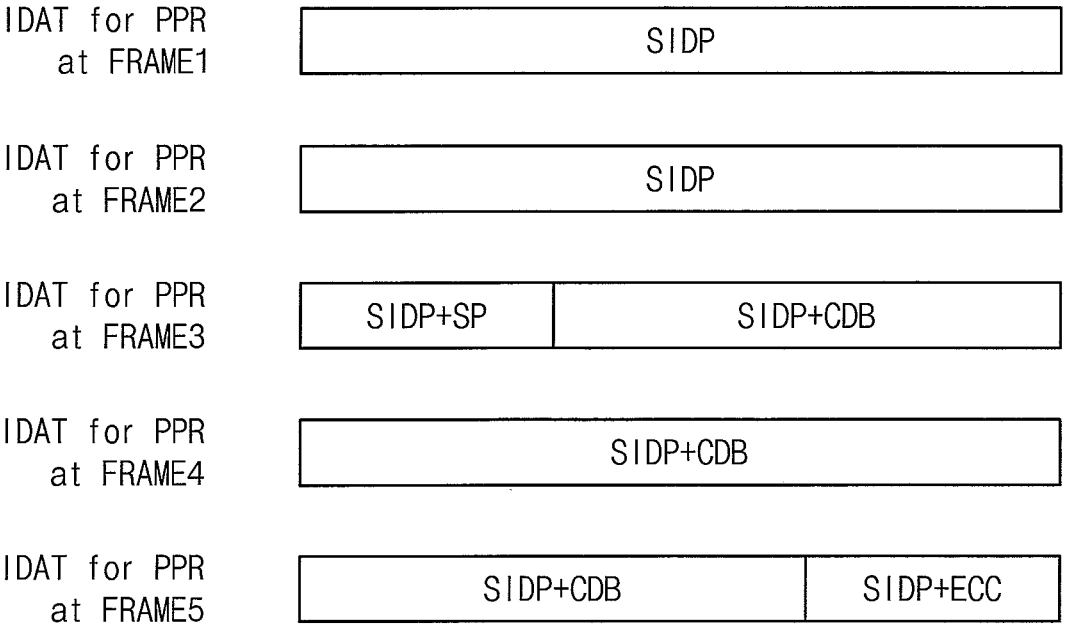
FIG. 11 is a diagram illustrating another example of input data for a partial panel region transferred between a host processor and a display device according to one or more example embodiments.
Figure 12:
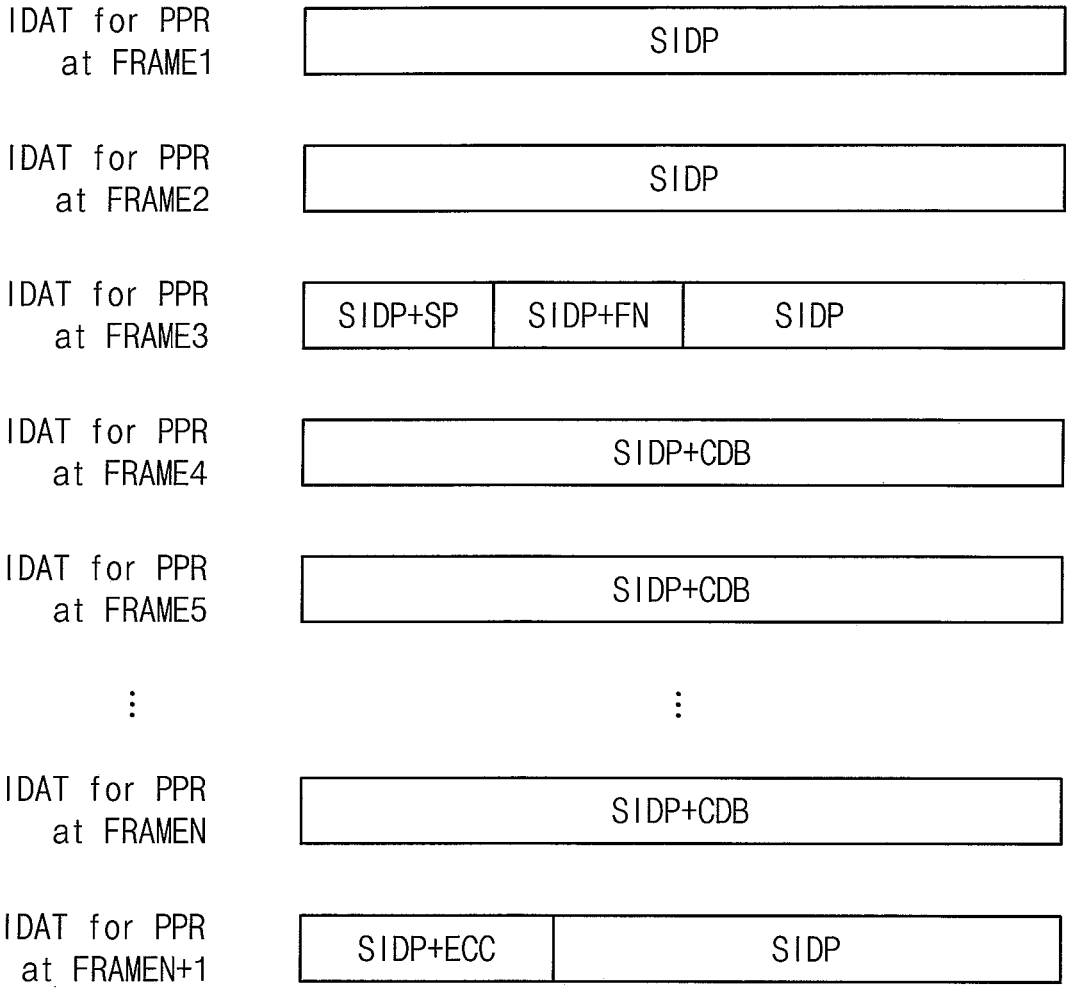
FIG. 12 is a diagram illustrating another example of input data for a partial panel region transferred between a host processor and a display device according to one or more example embodiments.
Figure 13:
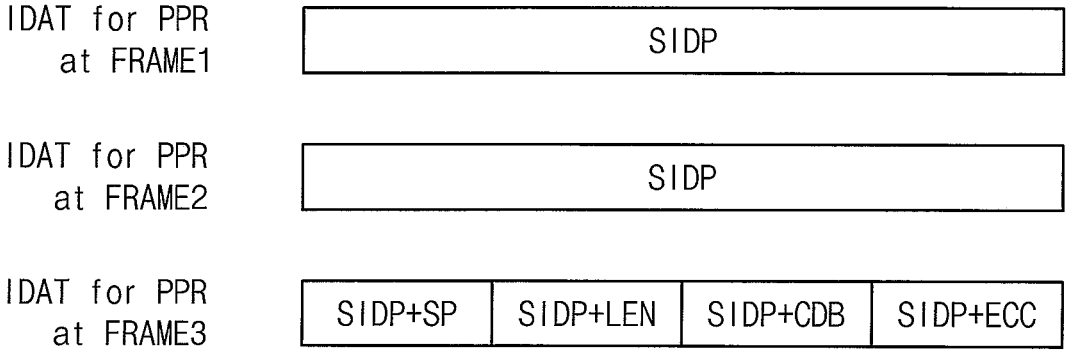
FIG. 13 is a diagram illustrating another example of input data for a partial panel region transferred between a host processor and a display device according to one or more example embodiments.

FIG. 9 is a flowchart illustrating a method of transferring image data and command data by a host processor and a method of receiving the image data and the command data by a display device according to one or more example embodiments; FIG. 10 is a diagram illustrating an example of input data for a partial panel region transferred between a host processor and a display device according to one or more example embodiments; FIG. 11 is a diagram illustrating another example of input data for a partial panel region transferred between a host processor and a display device according to one or more example embodiments; FIG. 12 is a diagram illustrating another example of input data for a partial panel region transferred between a host processor and a display device according to one or more example embodiments; and FIG. 13 is a diagram illustrating another example of input data for a partial panel region transferred between a host processor and a display device according to one or more example embodiments.

Referring to FIGS. 1 and 9, a host processor 200 may transfer input data IDAT including image data IMG to a display device 100, and the display device 100 may receive the input data IDAT including the image data IMG (S310).

The host processor 200 may identify a still image data portion SIDP in the input data IDAT, or the image data IMG (S320). In some example embodiments, the host processor 200 may identify whether the image data IMG for a partial panel region PPR represent a still image by comparing the image data IMG for the partial panel region PPR in a previous frame and the image data IMG for the partial panel region PPR in a current frame. In other example embodiments, the host processor 200 may identify whether the image data IMG for the partial panel region PPR represent the still image according to an application executed by the host processor 200. For example, as illustrated in FIG. 2B, in a case in which the host processor 200 executes a video application, the host processor 200 may be aware that the image data IMG for the partial panel region PPRb are the still image data portion SIDP.

A partial still image detector 160 of the display device 100 may detect the still image data portion SIDP in the input data IDAT by determining whether the input data IDAT for the partial panel region PPR represents the still image (S330).

Further, the display device 100 may store the detected still image data portion SIDP in a data portion storage 180 (S340).

The host processor 200 may encode command data CMD in the still image data portion SIDP (S350). For example, the host processor 200 may add the command data CMD to the still image data portion SIDP.

The host processor 200 may transfer the input data IDAT including the image data IMG in which the command data CMD are encoded in the still image data portion SIDP to the display device 100, and the display device 100 may receive the input data IDAT including the image data IMG in which the command data CMD are encoded in the still image data portion SIDP (S360).

A command decoder 190 of the display device 100 may extract the command data CMD from the input data IDAT by calculating a difference between the still image data portion SIDP stored in the data portion storage 180 and the still image data portion SIDP in which the command data are encoded or added (S370).

In some example embodiments, the command data CMD including a start pattern, command data bits, and an error correction code may be transferred in three frames. For example, as illustrated in FIG. 10, the host processor 200 may transfer, as the input data IDAT for the partial panel region PPR, the still image data portion SIDP representing the still image in first and second frames FRAME1 and FRAME2. The display device 100 may detect the still image data portion SIDP by comparing the input data IDAT for the partial panel region PPR in the first frame FRAME1 and the input data IDAT for the partial panel region PPR in the second frame FRAME2. The host processor 200 may encode a start pattern SP indicating that the command data CMD are to be transferred in the still image data portion SIDP in a third frame FRAME3, may encode command data bits CDB corresponding to contents of the command data CMD in the still image data portion SIDP in a fourth frame FRAME4, and may encode an error correction code ECC for error correction of the command data bits CDB in the still image data portion SIDP in a fifth frame FRAMES. The display device 100 may be informed that the command data CMD are to be transferred by decoding the still image data portion SIDP in which the start pattern SP is encoded in the third frame FRAME3, may receive the contents of the command data CMD by decoding the still image data portion SIDP in which the command data bits CDB are encoded in the fourth frame FRAME4, and may perform the error correction for the command data bits CDB by decoding the still image data portion SIDP in which the error correction code ECC is encoded in the fifth frame FRAMES.

In other example embodiments, as illustrated in FIG. 11, to transfer the command data CMD, the start pattern SP and the command data bits CDB may be encoded in the still image data portion SIDP in the third frame FRAME3, the command data bits CDB may be encoded in the still image data portion SIDP in the fourth frame FRAME4, and the command data bits CDB and the error correction code ECC may be encoded in the still image data portion SIDP in the fifth frame FRAMES. In some example embodiments, the same command data bits CDB may be transferred in the three frames FRAME3, FRAME4, and FRAMES. In this case, a data distortion caused by a transfer loss, etc. may be reduced, or may be readily corrected.

In still other example embodiments, as illustrated in FIG. 12, to transfer the command data CMD, the start pattern SP and a frame number FN may be encoded in the still image data portion SIDP in one frame FRAME3, the command data bits CDB may be encoded in the still image data portion SIDP in one or more frames FRAME4, FRAME5, . . . , FRAMEN indicated by the frame number FN, and the error correction code ECC may be encoded in the still image data portion SIDP in the next frame FRAMEN+1. In this case, the command data bits CDB may be transferred in a plurality of frames FRAME4, FRAME5, . . . , FRAMEN.

In still other example embodiments, as illustrated in FIG. 13, to transfer the command data CMD, the start pattern SP, a length information LEN indicating a length of the command data bits CDB, the command data bits CDB and the error correction code ECC may be encoded in the still image data portion SIDP in a single frame FRAME3. In this case, the command data CMD may be transferred in the single frame FRAME3.

Although FIGS. 10 through 13 illustrate various example of the command data CMD, the command data CMD according to example embodiments are not limited to the examples of FIGS. 10 through 13. For example, the command data CMD may include only the command data bits CDB without the start pattern SP and/or the error correction code ECC.

As described above, in the method of transferring the image data IMG and the command data CMD between the host processor 200 and the display device 100, the input data DAT in which the command data CMD are encoded in still image data portion SIDP are transferred. Accordingly, even if an interface mode between the host processor 200 and the display device 100 is not changed, the command data CMD may be transferred along with the image data IMG.

Figure 14:
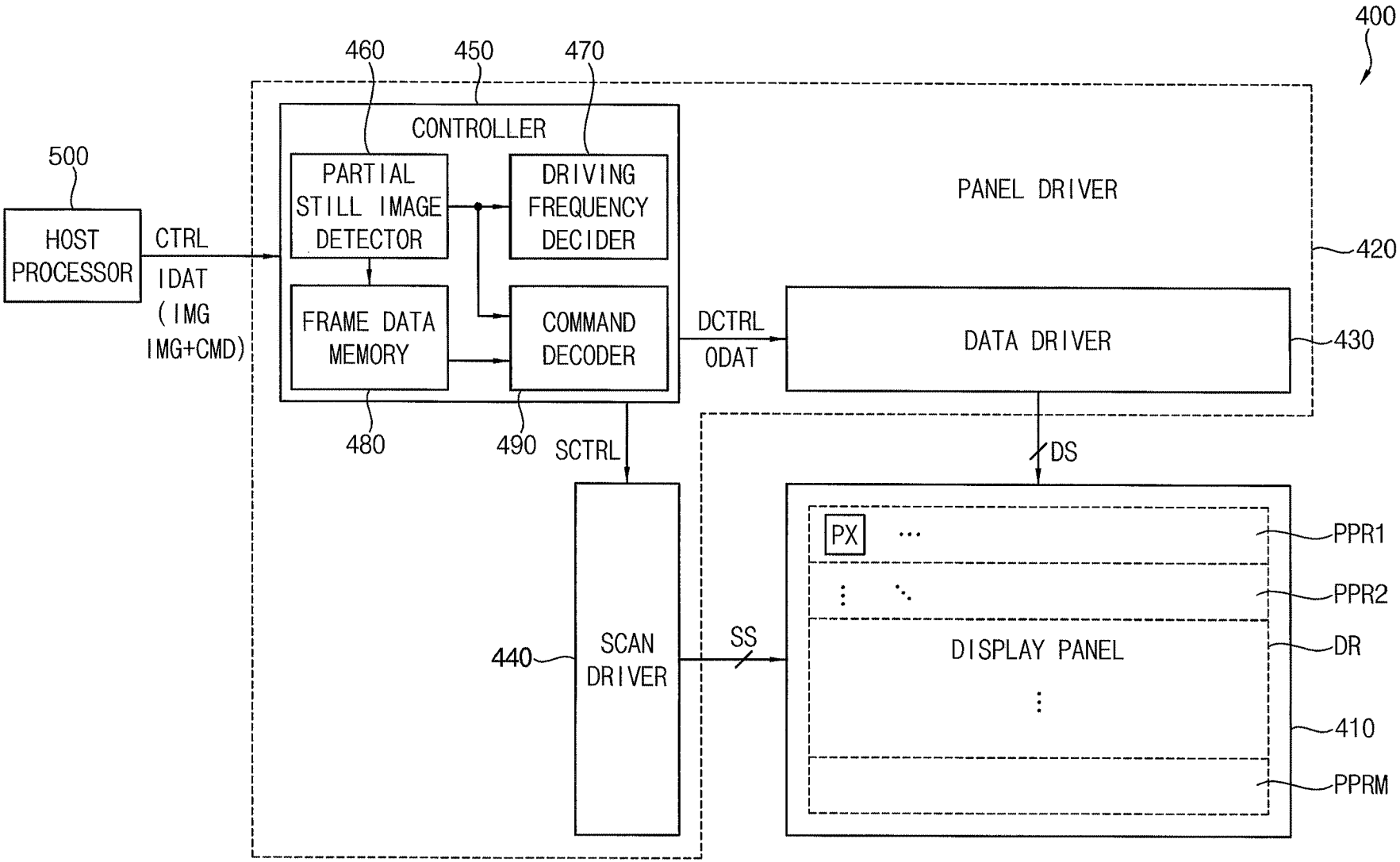
FIG. 14 is a block diagram illustrating a display device according to one or more example embodiments.
Figure 15:
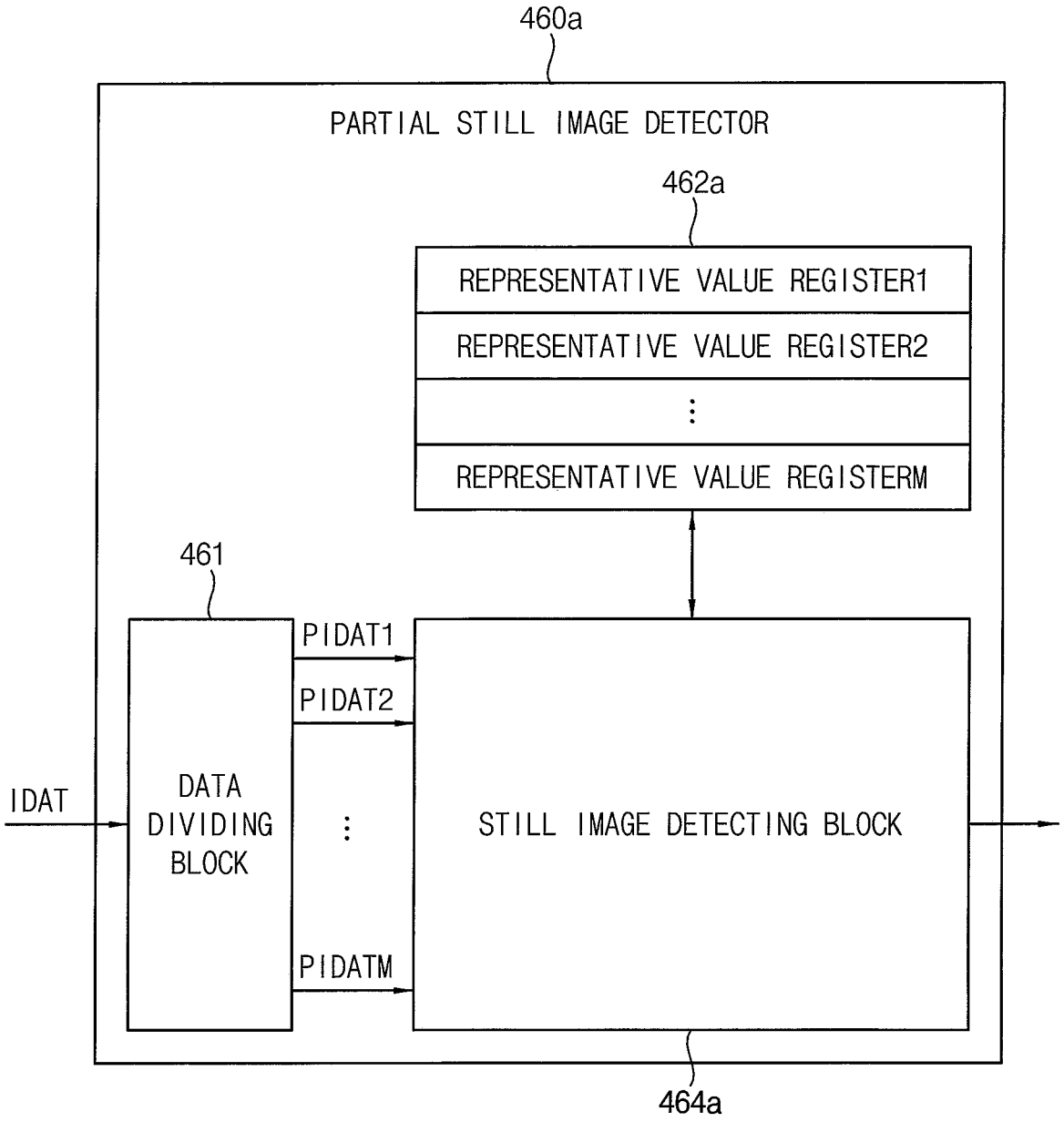
FIG. 15 is a block diagram illustrating an example of a partial still image detector included in a display device according to one or more example embodiments.
Figure 16:
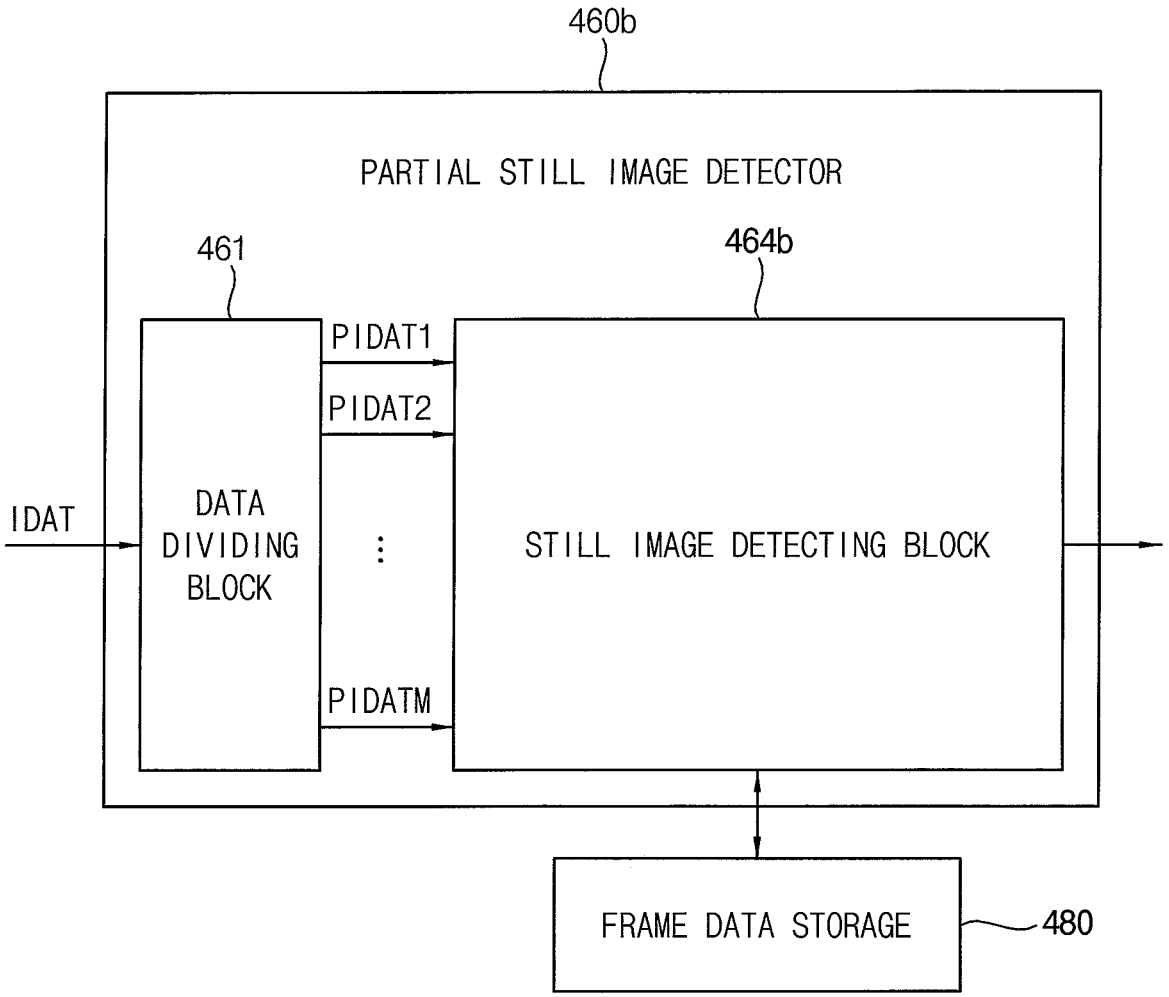
FIG. 16 is a block diagram illustrating another example of a partial still image detector included in a display device according to one or more example embodiments.

FIG. 14 is a block diagram illustrating a display device according to one or more example embodiments; FIG. 15 is a block diagram illustrating an example of a partial still image detector included in a display device according to one or more example embodiments; and FIG. 16 is a block diagram illustrating another example of a partial still image detector included in a display device according to one or more example embodiments.

Referring to FIG. 14, a display device 400 according to one or more example embodiments may include a display panel 410 and a panel driver 420. In some example embodiments, the panel driver 420 may include a data driver 430, a scan driver 440, and a controller 450. The controller 450 may include a partial still image detector 460, a driving frequency decider 470, a frame data storage 480, and a command decoder 490. The display device 400 of FIG. 14 may have a configuration and an operation similar to a configuration and an operation of the display device 100 of FIG. 1, except that the display device 400 may extract command data CMD encoded in a still image data portion for any one or more of a plurality of partial panel regions PPR1, PPR2, . . . , PPRM of the display panel 410.

In the display device 400, input data IDAT may be divided into a plurality of partial input data respectively corresponding to the plurality of partial panel regions PPR1, PPR2, . . . , PPRM of the display panel 410. The partial still image detector 460 may determine whether each of the plurality of partial input data represents a still image.

In some example embodiments, as illustrated in FIG. 15, a partial still image detector 460*a* may include a data dividing block 461, a plurality of representative value registers 462*a* (e.g., first through M-th representative value registers) and a still image detecting block 464*a*. The data dividing block 461 may divide the input data IDAT into the plurality of partial input data PIDAT1, PIDAT2, . . . , PIDATM respectively corresponding to the plurality of partial panel regions PPR1, PPR2, . . . , PPRM. In some example embodiments, each partial panel region PPR1, PPR2, . . . , PPRM may include one or more pixel rows, and each partial input data PIDAT1, PIDAT2, . . . , PIDATM may be the input data IDAT for the one or more pixel rows. The plurality of representative value registers 462*a* may correspond to the plurality of partial input data PIDAT1, PIDAT2, . . . , PIDATM. Each representative value register 462*a* may store a previous representative value of corresponding partial input data from among the plurality of partial input data PIDAT1, PIDAT2, . . . , PIDATM in a previous frame before the corresponding partial input data are detected as the still image data portion, and may store a still image representative value of the still image data portion after the corresponding partial input data are detected as the still image data portion. The still image detecting block 464*a* may calculate a current representative value of each of the plurality of partial input data PIDAT1, PIDAT2, . . . , PIDATM in a current frame. With respect to each partial input data PIDAT1, PIDAT2, . . . , PIDATM, or the corresponding partial input data, the still image detecting block 464*a* may determine whether the corresponding partial input data represent the still image by comparing the current representative value of the corresponding partial input data with the previous representative value before the corresponding partial input data are detected as the still image data portion, and may determine whether the corresponding partial input data represent the still image by determining whether a difference between the current representative value of the corresponding partial input data and the still image representative value is within a reference representative value range corresponding to a command data bit range after the corresponding partial input data are detected as the still image data portion.

In other example embodiments, as illustrated in FIG. 16, a partial still image detector 460*b* may determine whether each partial input data PIDAT1, PIDAT2, . . . , PIDATM represent the still image by using the frame data storage 480, and may include the data dividing block 461 and a still image detecting block 464*b*. The frame data storage 480 may store each partial input data PIDAT1, PIDAT2, . . . , PIDATM in a previous frame before each partial input data PIDAT1, PIDAT2, . . . , PIDATM is detected as the still image data portion, and may store the still image data portion after each partial input data PIDAT1, PIDAT2, . . . , PIDATM is detected as the still image data portion. The data dividing block 461 may divide the input data DAT into the plurality of partial input data PIDAT1, PIDAT2, . . . , PIDATM. The still image detecting block 464*b* may determine whether each partial input data PIDAT1, PIDAT2, . . . , PIDATM represents the still image by comparing each partial input data PIDAT1, PIDAT2, . . . , PIDATM in a current frame with each partial input data PIDAT1, PIDAT2, . . . , PIDATM in the previous frame stored in the frame data storage 480 before each partial input data PIDAT1, PIDAT2, . . . , PIDATM is detected as the still image data portion, and may determine whether each partial input data PIDAT1, PIDAT2, . . . , PIDATM represents the still image by determining whether a difference between each partial input data PIDAT1, PIDAT2, . . . , PIDATM in the current frame and the still image data portion stored in the frame data storage 480 is within a command data bit range after each partial input data PIDAT1, PIDAT2, . . . , PIDATM is detected as the still image data portion.

The command decoder 490 may extract the command data CMD from the input data DAT by decoding each partial input data PIDAT1, PIDAT2, . . . , PIDATM determined to represent the still image. For example, the command decoder 490 may extract the command data CMD in each partial input data PIDAT1, PIDAT2, . . . , PIDATM by subtracting the still image data portion stored in the frame data storage 480 from each partial input data PIDAT1, PIDAT2, . . . , PIDATM in the current frame.

In some example embodiments, a host processor 500 may select at least one partial input data from among the plurality of partial input data PIDAT1, PIDAT2, . . . , PIDATM representing the still image, and may encode the command data CMD in the selected partial input data, or in the selected still image data portion. In an example, partial input data representing the highest gray level from among the plurality of partial input data PIDAT1, PIDAT2, . . . , PIDATM representing the still image may be selected as the still image data portion in which the command data CMD are encoded. In this case, since the command data CMD may be encoded or added to the still image data portion corresponding to an image having the highest luminance, even if an image is undesirably or erroneously displayed based on not the still image data portion stored in the frame data storage 480, but the still image data portion in which the command data CMD are encoded, an image distortion may not be perceived by a user.

As described above, in the display device 400 according to one or more example embodiments, the partial still image detector 460 may determine whether each partial input data PIDAT1, PIDAT2, . . . , PIDATM represents the still image. The host processor 500 may encode the command data CMD in any one or more of the plurality of partial input data PIDAT1, PIDAT2, . . . , PIDATM, and the command decoder 490 may extract the command data CMD encoded in the any one or more of the plurality of partial input data PIDAT1, PIDAT2, . . . , PIDATM. Accordingly, even if an interface mode between the host processor 500 and the display device 400 is not changed, the display device 400 according to example embodiments may receive the command data CMD along with the image data IMG.

Figure 17:
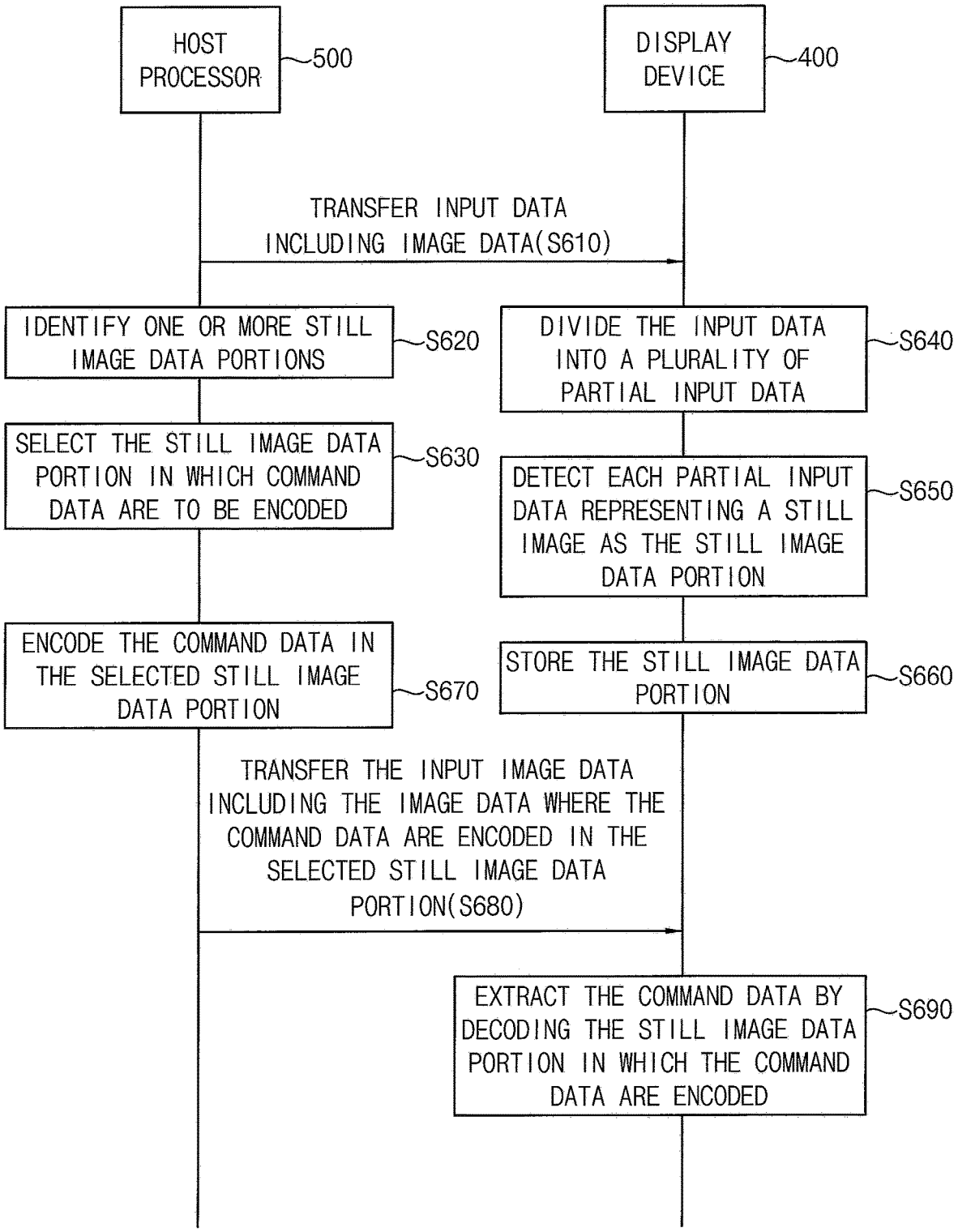
FIG. 17 is a flowchart illustrating a method of transferring image data and command data by a host processor and a method of receiving the image data and the command data by a display device according to one or more example embodiments.

FIG. 17 is a flowchart illustrating a method of transferring image data and command data by a host processor and a method of receiving the image data and the command data by a display device according to one or more example embodiments.

Referring to FIGS. 14 and 17, a host processor 500 may transfer input data IDAT including image data IMG to a display device 400, and the display device 400 may receive the input data IDAT including the image data IMG (S610).

The host processor 500 may identify one or more still image data portions in the input data IDAT, or the image data IMG (S620), and may select the still image data portion in which command data CMD are to be encoded (S630). For example, the host processor 500 may select the still image data portion in which command data CMD are to be encoded according to gray levels or luminances of the one or more still image data portions.

A partial still image detector 460 of the display device 400 may divide the input data IDAT into a plurality of partial input data PIDAT1, PIDAT2, . . . , PIDATM respectively corresponding to a plurality of partial panel regions PPR1, PPR2, . . . , PPRM (S640), and may detect each partial input data PIDAT1, PIDAT2, . . . , PIDATM representing the still image as the still image data portion by determining whether each partial input data PIDAT1, PIDAT2, . . . , PIDATM represents the still image (S650). Further, the display device 400 may store the detected still image data portion in a frame data storage 480 (S660).

The host processor 500 may encode the command data CMD in the selected still image data portion (S670). For example, the host processor 500 may add the command data CMD to the selected still image data portion.

The host processor 500 may transfer the input data IDAT including the image data IMG in which the command data CMD are encoded in the selected still image data portion to the display device 400, and the display device 400 may receive the input data IDAT including the image data IMG in which the command data CMD are encoded in the selected still image data portion (S680).

A command decoder 490 of the display device 400 may extract the command data CMD from the input data IDAT by decoding the still image data portion in which the command data CMD are encoded or added (S690). For example, with respect to each of partial input data determined to represent the still image from among the plurality of partial input data PIDAT1, PIDAT2, . . . , PIDATM, the command decoder 490 may calculate a difference between each partial input data PIDAT1, PIDAT2, . . . , PIDATM and a corresponding still image data portion stored in the frame data storage 480, and may extract the calculated difference other than 0 as the command data CMD.

Figure 18:
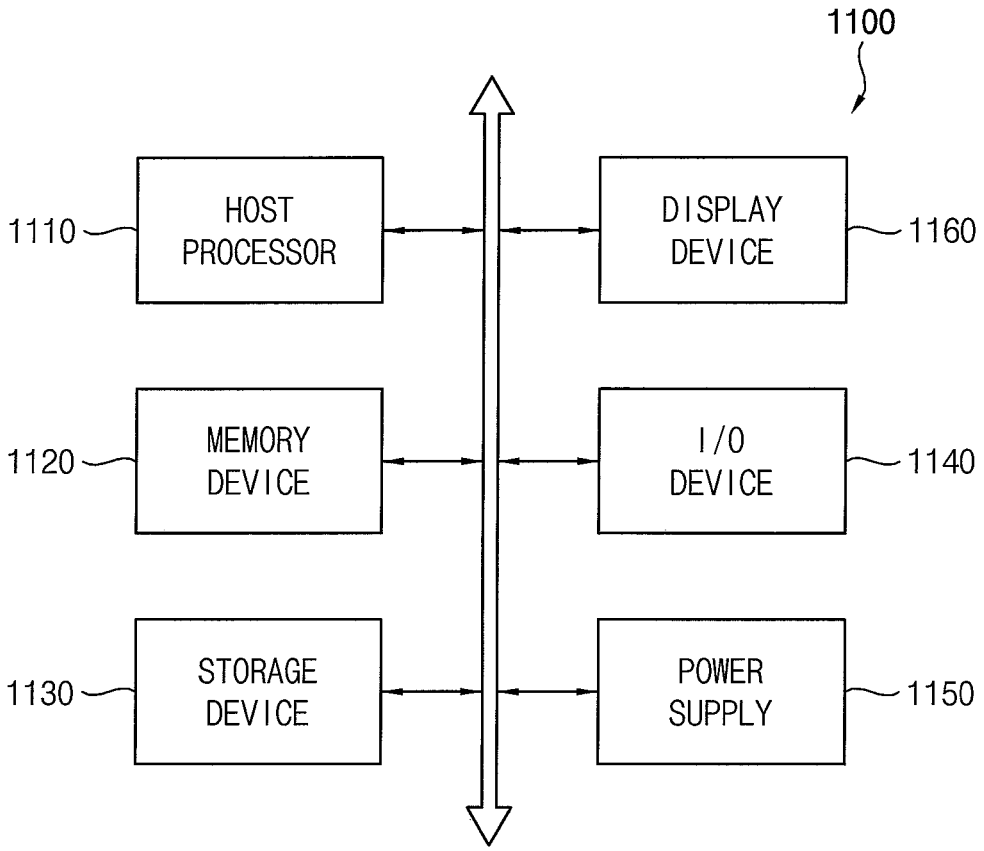
FIG. 18 is a diagram illustrating an electronic device including a display device according to one or more example embodiments.

FIG. 18 is a diagram illustrating an electronic device including a display device according to one or more example embodiments.

Referring to FIG. 18, according to one or more embodiments, an electronic device 1100 may include a host processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The host processor 1110 may perform various computing functions or tasks. The host processor 1110 may be an application processor (AP), a microprocessor, a central processing unit (CPU), etc. The host processor 1110 may be coupled to other components via an address bus, a control bus, a data bus, etc. Further, in some example embodiments, the host processor 1110 may be further coupled to an extended bus, such as a peripheral component interconnection (PCI) bus.

The memory device 1120 may store data for operations of the electronic device 1100. For example, the memory device 1120 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be any of an input device, such as a keyboard, a keypad, a mouse, a touch screen, etc., and an output device, such as a printer, a speaker, etc. The power supply 1150 may supply power for operations of the electronic device 1100. The display device 1160 may be coupled to other components through the buses or other communication links.

In the display device 1160, a partial still image detector may detect a still image data portion in input data. If the input data in which command data are encoded in the still image data portion are received, a command decoder of the display device 1160 may extract the command data from the input data by decoding the still image data portion in which the command data are encoded. Accordingly, even if an interface mode between the host processor 1110 and the display device 1160 is not changed (e.g., to a command mode of a mobile industry processor interface (MIPI)), the display device 1160 according to example embodiments may receive the command data along with image data.

The inventive concepts may be applied to any display device 1160, and any electronic device 1100 including the display device 1160. For example, the inventive concepts may be applied to any of a mobile phone, a smartphone, a wearable electronic device, a tablet computer, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of some example embodiments and is not to be construed as limiting thereof. Although some example embodiments have been described, those skilled in the art will readily appreciate that many modifications are possible in the example embodiments without materially departing from the novel teachings and aspects of the present inventive concept. Accordingly, all such modifications are intended to be included within the scope of the present inventive concept as set forth in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display device comprising:

a display panel comprising a plurality of pixels; and a panel driver configured to receive input data, and to drive the display panel based on the input data, wherein the panel driver comprises:

a partial still image detector configured to detect a still image data portion in the input data by determining whether at least a portion of the input data represents a still image; and a command decoder configured to extract command data from the input data that comprises the command data and the still image data portion by decoding the still image data portion in which the command data are encoded, wherein, when the portion of the input data in a second frame is the same as the portion of the input data in a first frame, the partial still image detector detects the portion of the input data as the still image data portion, wherein the panel driver is configured to receive the input data comprising the still image data portion in which the command data are encoded in a third frame, and wherein, to decode the still image data portion in which the command data are encoded, the command decoder is configured to calculate a difference between the still image data portion in the second frame and the still image data portion in the third frame.

2. The display device of claim 1, wherein a start pattern is encoded as the command data in the still image data portion in the third frame, wherein command data bits are encoded as the command data in the still image data portion in each of one or more fourth frames, and wherein an error correction code is encoded as the command data in the still image data portion in a fifth frame.

3. The display device of claim 1, wherein a start pattern and command data bits are encoded as the command data in the still image data portion in the third frame, wherein the command data bits are encoded as the command data in the still image data portion in each of one or more fourth frames, and wherein the command data bits and an error correction code are encoded as the command data in the still image data portion in a fifth frame.

4. The display device of claim 1, wherein a start pattern, command data bits, and an error correction code are encoded as the command data in the still image data portion in the third frame.

5. The display device of claim 1, wherein the command data are encoded in the still image data portion such that values of the command data are respectively added to sub-pixel image data included in the still image data portion.

6. The display device of claim 1, wherein the command data are encoded in the still image data portion such that a same one of values of the command data is added to sub-pixel image data of each pixel image data included in the still image data portion.

7. The display device of claim 1, wherein the command data are encoded in the still image data portion such that the command data are added to the still image data portion, and wherein values of the command data added to the still image data portion are within a command data bit range.

8. The display device of claim 1, wherein the panel driver further comprises a driving frequency decider configured to determine a driving frequency for a partial panel region of the display panel corresponding to the still image data portion as a low frequency lower than a normal driving frequency by analyzing the still image data portion when the still image data portion is detected.

9. The display device of claim 1, wherein the still image data portion in which the command data are encoded corresponds to image data for a partial panel region of the display panel, and wherein the partial panel region is configured to display the still image, and has a fixed position.

10. The display device of claim 1, wherein the partial still image detector comprises:

a representative value register configured to store a previous representative value of the portion of the input data in a previous frame before the still image data portion is detected, and to store a still image representative value of the still image data portion after the still image data portion is detected; and a still image detecting block configured to calculate a current representative value of the portion of the input data in a current frame, to determine whether the portion of the input data represents the still image by comparing the current representative value with the previous representative value before the still image data portion is detected, and to determine whether the portion of the input data represents the still image by determining whether a difference between the current representative value and the still image representative value is within a reference representative value range corresponding to a command data bit range after the still image data portion is detected.

11. The display device of claim 1, wherein the panel driver further comprises:

a data portion storage configured to store the portion of the input data in a previous frame before the still image data portion is detected, and to store the still image data portion after the still image data portion is detected, and wherein the partial still image detector comprises:

a still image detecting block configured to determine whether the portion of the input data represents the still image by comparing the portion of the input data in a current frame with the portion of the input data in the previous frame stored in the data portion storage before the still image data portion is detected, and to determine whether the portion of the input data represents the still image by determining whether a difference between the portion of the input data in the current frame and the still image data portion stored in the data portion storage is within a command data bit range after the still image data portion is detected.

12. The display device of claim 11, wherein the command decoder is configured to extract the command data from the input data by subtracting the still image data portion stored in the data portion storage from the portion of the input data in the current frame.

13. The display device of claim 1, wherein the input data are divided into a plurality of partial input data respectively corresponding to a plurality of partial panel regions of the display panel, and wherein the still image data portion in which the command data are encoded are selected from among the plurality of partial input data representing the still image.

14. The display device of claim 1, wherein partial input data representing a highest gray level from among a plurality of partial input data representing the still image is selected as the still image data portion in which the command data are encoded.

15. The display device of claim 1, wherein the partial still image detector comprises:

a data dividing block configured to divide the input data into a plurality of partial input data respectively corresponding to a plurality of partial panel regions of the display panel;

a plurality of representative value registers for the plurality of partial input data, each of the plurality of representative value registers configured to store a previous representative value of corresponding partial input data from among the plurality of partial input data in a previous frame before the corresponding partial input data are detected as the still image data portion, and to store a still image representative value of the still image data portion after the corresponding partial input data are detected as the still image data portion; and a still image detecting block configured to calculate a current representative value of each of the plurality of partial input data in a current frame, to determine whether the corresponding partial input data represent the still image by comparing the current representative value of the corresponding partial input data with the previous representative value before the corresponding partial input data are detected as the still image data portion, and to determine whether the corresponding partial input data represent the still image by determining whether a difference between the current representative value of the corresponding partial input data and the still image representative value is within a reference representative value range corresponding to a command data bit range after the corresponding partial input data are detected as the still image data portion.

16. The display device of claim 1, wherein the input data are divided into a plurality of partial input data respectively corresponding to a plurality of partial panel regions of the display panel, wherein the panel driver further comprises:

a frame data storage configured to store each of the plurality of partial input data in a previous frame before each of the plurality of partial input data is detected as the still image data portion, and to store the still image data portion after each of the plurality of partial input data is detected as the still image data portion, and wherein the partial still image detector comprises:

a data dividing block configured to divide the input data into the plurality of partial input data; and a still image detecting block configured to determine whether each of the plurality of partial input data represents the still image by comparing each of the plurality of partial input data in a current frame with each of the plurality of partial input data in the previous frame stored in the frame data storage before each of the plurality of partial input data is detected as the still image data portion, and to determine whether each of the plurality of partial input data represents the still image by determining whether a difference between each of the plurality of partial input data in the current frame and the still image data portion stored in the frame data storage is within a command data bit range after each of the plurality of partial input data is detected as the still image data portion.

17. A method of receiving image data and command data by a display device, the method comprising:

receiving input data comprising the image data;

detecting a still image data portion in the input data by determining whether at least a portion of the input data represents a still image;

storing the still image data portion;

receiving the input data comprising the image data in which the command data are encoded in the still image data portion; and extracting the command data from the input data that comprises the command data and the still image data portion by calculating a difference between the stored still image data portion and the still image data portion in which the command data are encoded, wherein, when the portion of the input data in a second frame is the same as the portion of the input data in a first frame, the portion of the input data is detected as the still image data portion, wherein the input data comprising the still image data portion in which the command data are encoded are received in a third frame, and wherein, to decode the still image data portion in which the command data are encoded, a difference between the still image data portion in the second frame and the still image data portion in the third frame is calculated.

18. A method of transferring image data and command data to a display device by a host processor, the method comprising:

transferring input data comprising the image data to the display device;

identifying a still image data portion in the input data;

encoding the command data in the still image data portion; and transferring the input data comprising the image data in which the command data are encoded in the still image data portion to the display device, wherein to encode the command data in the still image data portion, values of the command data are added to pixel image data of the still image data portion.

* * * * *